US009303376B2

(12) United States Patent
Arntz

(10) Patent No.: US 9,303,376 B2
(45) Date of Patent: Apr. 5, 2016

(54) SNOW REMOVAL DEVICE

(71) Applicant: Technische Universiteit Eindhoven, Eindhoven (NL)

(72) Inventor: Hendrikus Petrus Maria Arntz, Eindhoven (NL)

(73) Assignee: Technische Universiteit Eindhoven, Eindhoven (NL)

( * ) Notice: Subject to any disclaimer, the term of this patent is extended or adjusted under 35 U.S.C. 154(b) by 0 days.

(21) Appl. No.: 14/391,167

(22) PCT Filed: Apr. 8, 2013

(86) PCT No.: PCT/EP2013/057325
§ 371 (c)(1),
(2) Date: Oct. 8, 2014

(87) PCT Pub. No.: WO2013/153040
PCT Pub. Date: Oct. 17, 2013

(65) Prior Publication Data

US 2015/0052784 A1 Feb. 26, 2015

Related U.S. Application Data

(60) Provisional application No. 61/623,918, filed on Apr. 13, 2012.

(51) Int. Cl.
*E01H 5/00* (2006.01)
*E01H 5/04* (2006.01)
(Continued)

(52) U.S. Cl.
CPC ..... *E01H 5/045* (2013.01); *E01H 5/00* (2013.01); *E01H 5/073* (2013.01); *E01H 5/092* (2013.01); *E01H 5/096* (2013.01); *E01H 5/098* (2013.01)

(58) Field of Classification Search
CPC ..... B30B 11/24; E01C 19/4893; E01F 7/02; E01H 5/00; E01H 5/096; E01H 5/09; E01H 5/097; E01H 5/045; E01H 5/076; E01H 5/073; E01H 5/092; E01H 5/098
USPC ..... 37/225, 223, 239, 249, 250, 257, 260; 198/522, 570, 625
See application file for complete search history.

(56) References Cited

U.S. PATENT DOCUMENTS 415,317 A * 11/1889 Bakkethun ..... E01H 8/06 198/518
684,052 A 10/1901 Farquhar
(Continued)

FOREIGN PATENT DOCUMENTS

CA 454349 1/1949
DE 4022390 4/1992
(Continued)

*Primary Examiner* — Robert Pezzuto
(74) *Attorney, Agent, or Firm* — Lumen Patent Firm

(57) ABSTRACT

A snow removal system is provided that includes a compression module having a tubular casing with an inlet, and an outlet having a converging cross-sectional surface area shape and air-hole perforations, a conveyor screw concentric to the casing spanning from the inlet to the outlet is powered to move and compact the snow at the outlet, a conveyor belt moves the output snow away from the compression module at a velocity $v_1$, a moveable truss houses the conveyor belt and supports the compression module, the device contacts a snow-covered surface and the truss moves at a velocity $v_2$ perpendicular to the snowplow, where $v_1$ is great enough to move the snow from the compression module when the truss moves at a velocity $v_2$, the conveyor screw turns at a rate that to incorporate $V_1$ and $v_2$ to ensure the conveyor belt capacity is not exceeded.

13 Claims, 17 Drawing Sheets

(51) Int. Cl.
*E01H 5/07* (2006.01)
*E01H 5/09* (2006.01)

(56) References Cited

U.S. PATENT DOCUMENTS

| | | | | | |
|---|---|---|---|---|---|
| 1,252,164 | A | | 1/1918 | Peltier | |
| 1,508,716 | A | | 9/1924 | Ochs | |
| 3,791,053 | A | * | 2/1974 | Breckbill | B30B 11/24 198/522 |
| 4,393,537 | A | | 7/1983 | Reprogle | |
| 4,404,817 | A | * | 9/1983 | Cox, III | F25C 5/18 62/320 |
| 4,443,958 | A | | 4/1984 | Huotari | |
| 4,651,452 | A | | 3/1987 | Husso | |
| 5,951,782 | A | | 9/1999 | Truitt | |

FOREIGN PATENT DOCUMENTS

| | | |
|---|---|---|
| DE | 29502694 | 6/1995 |
| DE | 29719508 | 2/1998 |
| DE | 20106150 | 7/2001 |
| EP | 0197259 | 10/1986 |
| EP | 0197258 | 10/1989 |
| EP | 0296563 | 2/1992 |
| EP | 0727527 | 8/1996 |
| EP | 0769589 | 4/1997 |
| FR | 2040831 | 1/1971 |
| FR | 2116956 | 7/1972 |
| FR | 2652103 | 3/1991 |
| FR | 2901290 | 11/2007 |
| GB | 1228730 | 4/1971 |
| WO | WO2010/105760 | 9/2010 |

* cited by examiner

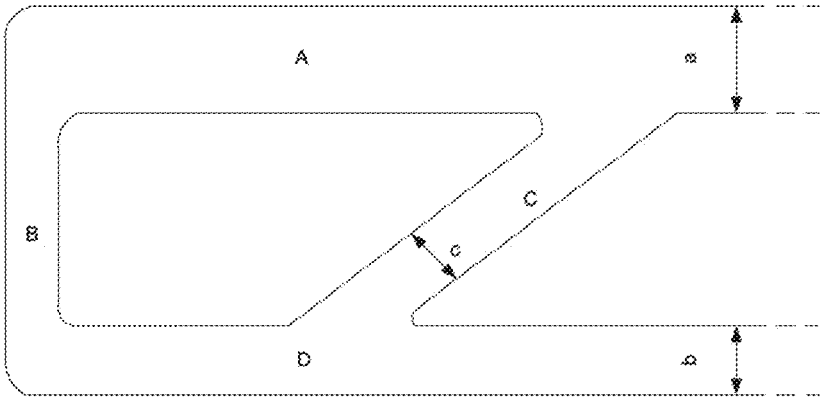
A: runway, B: exit, C: rapid exit, D: taxiway
a ≈ 40m, b ≈ 20m and c ≈ 30m
*FIG. 1* *(prior art)*
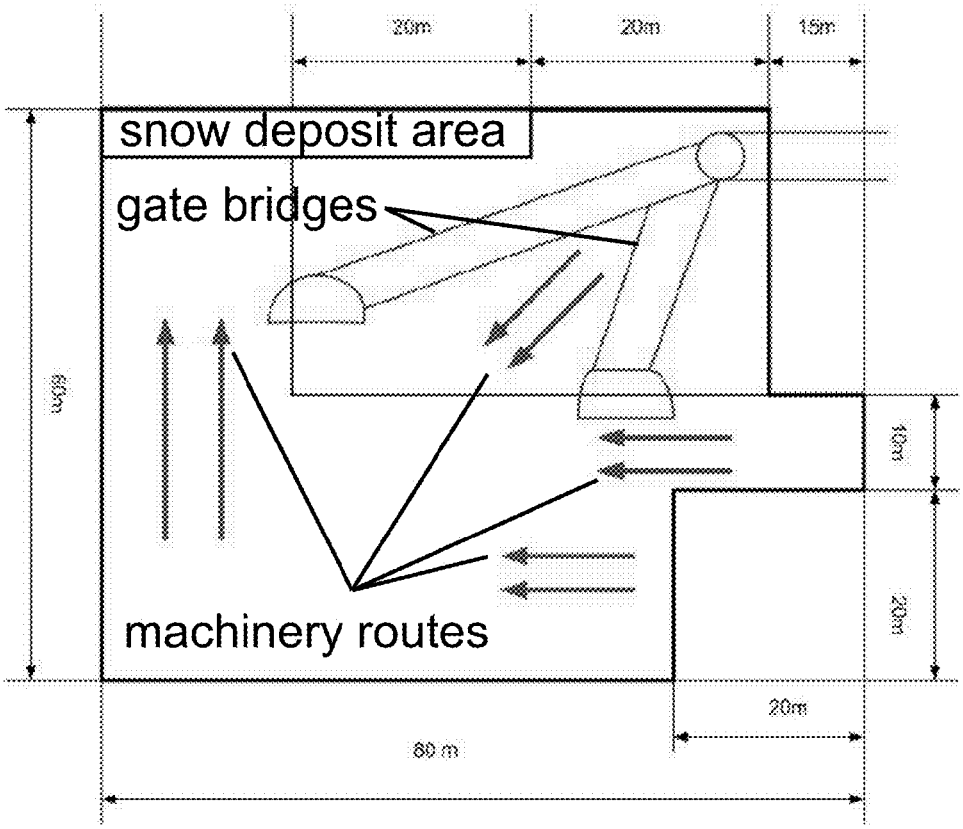
*FIG. 2* *(prior art)*

SNOW REMOVAL DEVICE

CROSS-REFERENCE TO RELATED APPLICATIONS

This application is a 371 of PCT/EP2013/057325 filed on Apr. 8, 2013. PCT application PCT/EP2013/057325 filed on Apr. 8, 2013 claims the benefit of U.S. Provisional application 61/623,918 filed on Apr. 13, 2012.

FIELD OF THE INVENTION

This invention relates to snow removal devices, methods and systems.

BACKGROUND OF THE INVENTION

The removal of snow at airports is of social and economical relevance. Airport downtime costs are in the order of tens of thousands Euros per minute for hub airports.

The scale of snow removal varies according to airport size and geographic location. The snow removal operation of Amsterdam Airport Schiphol (AAS) is taken as a reference case. AAS handles the following guidelines for their snow removal operation:

1. AAS remains open for air traffic as long as possible.
2. AAS strives to the least amount disruptions as possible for the airport operations.
3. After calamities the fight on snow and slipperiness has the highest priority.
4. All assigned staff will be employed for this purpose.

At an airport the tarmac to be cleared can be categorized in runways, exits, taxiways and platforms. These can be released when they are cleared of snow and the tarmac again complies to the operating standards of AAS. A runway is fully in operation again when the entire surface is cleared of snow. This includes the exit at the head and tail of the runway, the second and third rapid exit, and the taxiway parallel to the runway.

In FIG. 1 the definition of a runway, exit, rapid exit and a taxiway is schematically illustrated. The dimensions differ per runway, but the given dimensions in FIG. 1 give a good estimation of the size. The shoulders are not illustrated, typically they are a third of the width of a runway, taxiway or exit.

A platform is the place where airplanes are parked during boarding, a schematic view of a platform is given in FIG. 2.

The coefficient of friction $\mu$ between an airplanes' tire and the runway must be greater or equal to 0.25. Where $\mu$ is defined as the ratio between the friction force and the normal force. If the coefficient of friction after clearing is smaller than 0.25 the runway has to be cleared again. This criteria is not equal for all airports. The US Federal Aviation Administration (FAA) advises a minimum $\mu$ of 0.26. The FAA advises US airports through Advisory Circulars. Some are guidelines and some are mandatory.

AAS has different standards for runways, exits, taxiways and platforms. For runways these are:

1) At least one runway should be operational with a $\mu \geq 0.25$ and with a guaranteed capacity of 30 starts or landings per hour.
2) 23:00-6:00 (local time): At unfavorable conditions a number of starts could be postponed until the runway is cleared of snow.
3) 5:30-23:00 (local time): Within 40 minutes after passing of the snow precipitation or freezing rain a second runway must be operational.

For exits and taxiways the friction coefficient must be $\mu \geq 0.25$ and the maximum thickness of the layer of contamination is 4 mm. Contamination is the collective for snow, slush, water and chemicals. For a platform there is no criterion for the surface friction. Depending on the location of the platform it must be completely or partially cleared of snow and ice.

Airports have different kinds of equipment for snow removal. A Runway Sweeper (RS) is a transformed truck that removes the snow in three stages. First a blade plow plows the majority of the snow towards the side. Then a broom clears the tarmac of snow, which is compressed between the pores of the tarmac and finally a blower blows the last remains to the side. An example of a runway sweeper includes a truck with a hitched broom is called a Hitched Broom Truck (HBT). The function of the HBT is to brush the tarmac. An example of an HBT includes blade plows that have limited casting range and are not capable of displacing very deep or very hard snow. This has led to the development of rotating cutting devices with one or more rotating elements. All designs of Rotary Plows (RP) cut the snow by means of a rotating element on the right side and on the left side a blade plow. The function of this blade plow is to remove the snow from the vicinity of the landing lights and prevents the RP of damaging the landing lights. Potassium Formate (PF) is sprayed on the runway. The goal of PF is to decrease the freezing point of $H_2O$. The concentration of PF in $H_2O$ is proportional to the decrease in freezing point, therefore PF is sprayed when the majority of snow is removed from the runway.

For the removal of snow from runways, taxiways and exits there are two snow fleets used at AAS. The AAS snow feet includes the following vehicles and persons: 1 manager, 1 coordinator, 8-runway sweepers including operators, 1 blade plow including operator, 1 rotary plow including operator, 1 hitched broom truck including operator, and 1 sprinkler machine including operator.

The manager has the general overview of a snow fleet and a coordinator controls the individual machines. A snow schematic view of the snow fleet in operation is given in FIG. 3.

In this example, if a snow fleet removes snow from a taxiway the number of runway sweepers is decreased to 5. The majority of the snow on a platform is removed by blade plows and the last remains by HBT's. In FIG. 2 a platform is shown, in addition to the route of the blade plows and HBT's, with the snow deposit area.

Airports apply different kind of methods depending on the weather conditions. These methods are:

1) Preventive mechanical removal: When frost is expected any water pools that might be present are removed. This will be done by HBT's on runways, exits, taxiways and platforms.
2) Mechanical removal: In the case of snow, slush, hail or pieces of ice the removal will be done by a snow fleet. Slush is a mixture of ice and water. In case of dry or extreme snowfall, mechanical removal of snow is assumed to be better than spraying potassium formate. In the last case there is a chance that the dry snow might stick to the liquid and forms a layer difficult to remove.
3) Preventive spraying of potassium formate: The prevention of frost on runways, exits and taxiways. On the tarmac an amount of 25 $g/m^2$ of potassium formate will be sprayed. If hail precipitation is expected the amount will be increased to 40 $g/m^2$.
4) Corrective spraying of potassium formate: The removal of hail, frost or frozen slush on the runway, exit and platforms. The amount of potassium formate to be sprayed is 40 $g/m^2$. This is an emergency measure.

5) Corrective scattering of de-icing grains: The removal of ice from the tarmac, after which the mechanical removal method can start. This is an emergency measure.
6) Sand scattering: The sand will make the ice surface rough. This is a final emergency measure.

In the early twentieth century snowplows made their entry due to the motorization. In 1927 for example the company Good Roads advertised for snowplows that could be mounted on every truck.

The focus of improving snow removal is on four main criteria that include:

1) Decrease emissions. ACI Europe is the council of over 400 European airports. In 2009 ACI Europe launched the Airport Carbon Accreditation program. The member airports committed to the ultimate goal of becoming carbon neutral. A decrease of emissions will imply a decrease of fuel use. This means the required tank time per snowfall can be decreased which has a positive side effect on the operational costs.
2) Decrease costs. At the moment the capital expenditures (CAPEX) of a snow fleet are between 8 and 9 million Euros and the economic lifetime is 15 years. Furthermore the snow removal machines are dead capital for most time of the year. The current technology results in high operational expenditures (OPEX) due to two characteristics. One snow fleet includes 12 operators and 2 managers, the companion and the coordinator. A decrease of machines will lead to a decrease in labor costs. And the downtime costs of tens of thousands of Euros lead to high OPEX. A faster operation will decrease these downtime costs.
3) Decrease organizational complexity. FIG. 3 shows the formation of a snow fleet. It is essential the snow fleet holds this formation over the entire runway. This requires intensive training of the personnel. The main concern of the snow removal staff is to manage this organizational complexity. A decrease in the number of operators will simplify the operation.
4) Increase capabilities. An airport is mandatory to remove the Foreign Object Debris (FOD) from the runway. Examples of FOD are small stones, nuts and bolts. At the moment the FOD removal operation is done by other machines. A combination of to multiple tasks in one machine will have a positive effect on costs and the operational complexity. The current substitute technique and the improved technique will be assessed on these main criteria. The current substitute technique is heated pavements.

Centerline lights indicate the centerline of the runway to pilots and are shown in FIG. 4. These centerline lights are slightly sunk in the runway, but can still form an obstacle for plows. The dimensions of a center light are given in FIG. 4. AAS noted in the winter of 2010/2011 a significant damage to center lights.

The FAA and the US Department of Defense (DOD) combined their regulations for surface drainage design. The maximum transverse slope is 2% and is a trade off between drive comfort and drainage. FIG. 5 shows the consequence of the transverse slope. A plow, or multiple plows, must follow this slope.

Airfield signage is intended to provide information and direction to pilots. For example, a sign tells the pilot he is on taxiway R and the arrow indicates him where he will intersect taxiway W2. According to the FAA, post-clearing operations must be conducted to ensure the visibility of airfield signage. The distance of these signs from the pavements edge depends on its size. According to the FAA this is between 3 and 18 meters, ranging from the smallest to the largest sign.

All existing heated pavement technologies are characterized by the transfer of heat from an energy source to the tarmac. Geothermal energy is the most utilized energy source. In 2010, 423,830 TJ of geothermal energy was used globally. This is a yearly increase of 9.3% since 1995. In 2010 the fraction of geothermal energy used for snow melting applications was 0.44%, which is 1,845 TJ. The applications are limited to Argentina, Japan, Switzerland, Iceland and the United States. 78% of the total energy used for snow melting is applied in Iceland. The costs of energy for passive methods depends significantly on the available local natural resources.

FIGS. 6A-6B show the basics of an aquifer thermal energy storage (ATES) system. In summer water from the cold aquifer can be applied for cooling and in winter this works vice versa. It contains at least two boreholes that lead to suitable aquifer layers where groundwater is stored. A suitable aquifer layer is high permeable and the groundwater it contains is flowing slow. ATES can be fully automated in order to minimize operational activities in winter. An additional advantage of a heating system is the reduction of seasonal temperature fluctuations. This will increase the lifetime of the tarmac.

The input temperature of the groundwater from the warm aquifer in winter is about 15° C. at AAS. The required temperature of the heat transfer fluid for the most extreme snowfall in the past twenty years is 65° C. A conventional ATES system normally comprises a heat pump to heat the water up to a maximum of 40° C. If an extreme snowfall occurs additional heating by, for example, a boiler is required.

It is assumed the ATES system can be installed during the normal renovation of the runways tarmac. Downtime costs due to installation are therefore excluded in the investment. Heated pavement technology is not competitive with the current technology based on the first two criteria, the decrease of emissions and costs.

What is needed is a snow removal system and method that addresses the challenges to decrease emissions, decrease costs, and decrease the organizational complexity.

Untouched snow is a material easy to handle. However once it is touched, mixed with chemicals and when it is aged it is not. The amount of energy on plowing is proportional to the mass of the snow in front of the plow. It is also the only variable that can be altered, since the dynamic friction coefficient between snow and tarmac is constant for a certain snow type. A decrease of emissions can therefore be realized by taking the snow directly off the tarmac. What remains is the energy on brushing and blowing. If the new technique can take off the snow directly from the tarmac and fulfills the $\mu \geq 0.25$ criterion, brushing and blowing will become superfluous. The challenge to decrease the organizational complexity is a function of the snow removal operation. This complexity is a consequence of the amount of operators, that need to be managed under time pressure. If the amount of operators can be decreased this will lead to an organizational simplification.

What is further needed is a system and method that enables other features than snow removal to be implemented. On a runway multiple tasks are performed. These tasks include FOD removal, friction measurements and tarmac status measurements. The most frequent and time-consuming runway operation is FOD removal. AAS for example removes its FOD every night. This requires several hours per runway, including exits and the parallel taxiway.

SUMMARY OF THE INVENTION

To address the needs in the art, a snow removal system is provided that includes a snow removal system having a compression module, where the compression module has a tubular casing with a snow inlet and a snow outlet, where the snow outlet can be a converging or straight cross-section tubular shape, where the tubular casing is perforated with air holes. The compression module further includes a conveyor screw that rotates on a shaft that is disposed concentric to the tubular casing, where the conveyor screw spans from the snow inlet to the snow outlet, where the conveyor screw is powered to move snow from the snow inlet to the snow outlet and compacts the snow to a compressed state at the snow outlet, where air from the snow is exhausted through the air holes, where the compressed snow is output from the snow outlet. The snow removal system further includes a conveyor belt disposed to receive the compressed snow from the snow outlet and is disposed to move the compressed snow at a velocity $v_1$ from the snow outlet to a location away from the compression module, and a moveable truss that houses the conveyor belt, where the movable truss supports the compression module, where the movable truss moves at a velocity $v_2$, where the $v_1$ is a value that is great enough to remove the compressed snow away from the compression module when the truss moves at a velocity $v_2$, where the conveyor screw motor turns the conveyor screw to output the compressed snow at a rate that incorporates the $v_1$ and the $v_2$ to ensure a capacity to move the compressed snow away from compression module by the conveyor belt is not exceeded.

According to one aspect of the invention, the truss further includes a sweeper and a vacuum that are disposed behind the movable truss and inline with the compression module, where the sweeper sweeps snow from the snow-covered surface to the vacuum, where the vacuum outputs the swept snow to the conveyor belt.

In another aspect of the invention, the truss further includes an anti freeze liquid sprayer, to where the anti freeze liquid sprayer deposits antifreeze to a surface removed of snow.

In yet another aspect of the invention, the conveyor screw shaft has a hollow shaft that is perforated with air holes, where air from the snow is exhausted through the air holes.

In yet another aspect of the invention, the conveyor screw shaft has a diverging shaft cross-section along the snow outlet.

According to one aspect of the invention, the conveyor screw has a constant screw pitch or a decreasing screw pitch.

In a further aspect of the invention, the movable truss comprises a driving truss or a towable truss.

According to one embodiment the snow removal system includes a compression module having a tubular casing with a snow inlet and a snow outlet, where the snow outlet has a converging or straight cross-section tubular shape, where the tubular casing is perforated with air holes, the compression module further includes a conveyor screw that rotates on an axis that is disposed concentric to the tubular casing, where the conveyor screw spans from the snow inlet to the snow outlet, where the conveyor screw is powered to move snow from the snow inlet to the snow outlet and compacts the snow to a compressed state at the snow outlet, where air from the snow is exhausted through the air holes, where the compressed snow is output from the snow outlet.

According to one aspect the current embodiment further includes a snow container that receives the compressed snow output from the snow outlet, where the snow container stores the compressed snow. In one aspect the snow container has a dumping container, or a snow cube exerting container.

In another aspect of the current embodiment, the conveyor screw shaft has a hollow shaft that is perforated with air holes, where air from the snow is exhausted through the air holes.

According to one aspect of the current embodiment, the conveyor screw shaft has a diverging shaft cross-section along the snow outlet.

In yet another aspect of the current embodiment, the conveyor screw has a constant screw pitch or a decreasing screw pitch.

BRIEF DESCRIPTION OF THE DRAWINGS

FIG. 1 shows a schematic view of a prior art runway, exit, rapid exit and taxiway.

FIG. 2 shows a schematic view of a prior art platform.

DETAILED DESCRIPTION

The current invention is a snow removal system, method and/or process that addresses the needs in the art, including removing all snow from the tarmac directly, decreasing the number of operators, increasing removal speed, and is capable of removing FOD.

Figure 3:
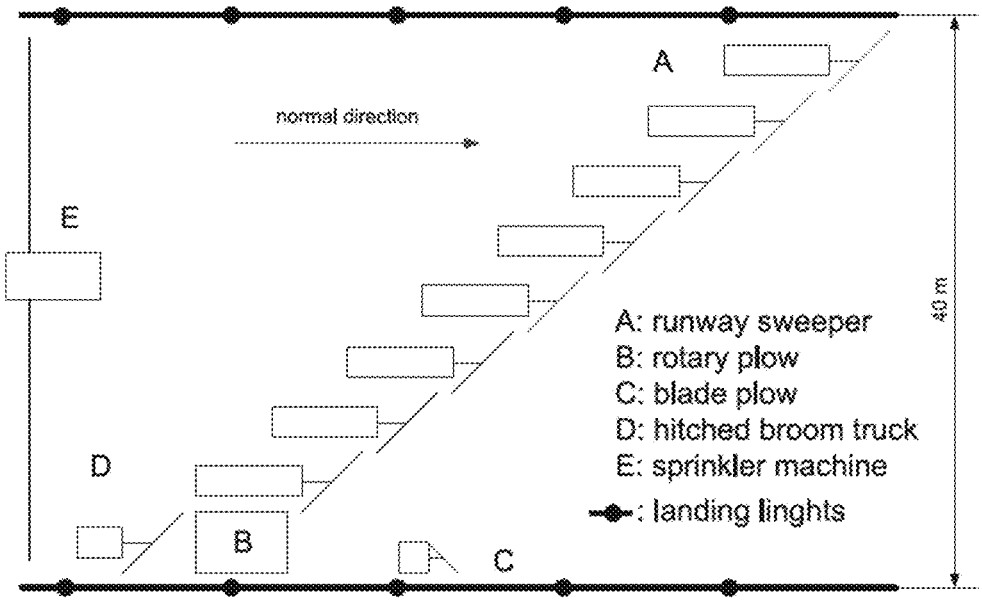
FIG. 3 (prior art)
FIG. 3 shows prior art schematic view of a snow fleet.
Figure 4:
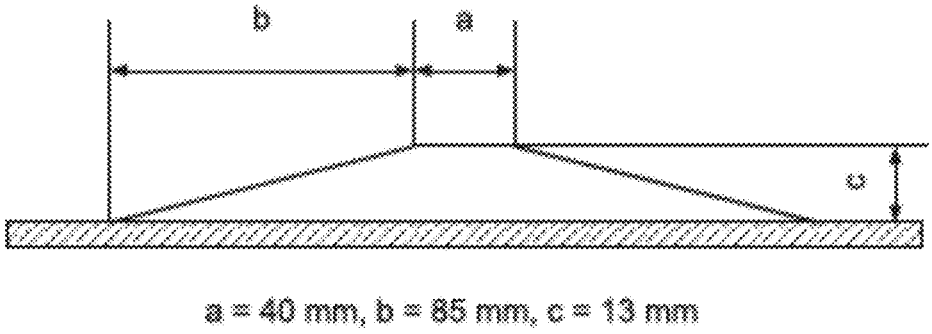
FIG. 4 (prior art)
FIG. 4 shows prior art center lights.
Figure 5:
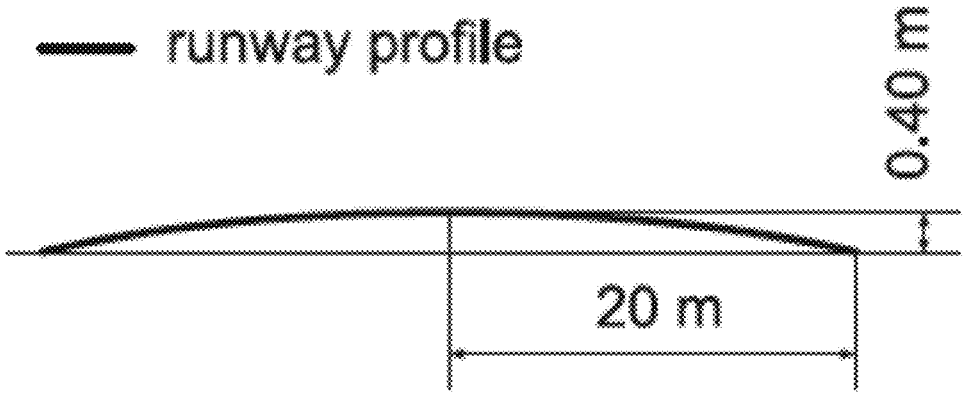
FIG. 5 (prior art)
FIG. 5 shows a cross sectional view of a runway, where the maximum height difference between the center and side of a 40 meters wide runway is 0.40 meters.
Figure 6A:
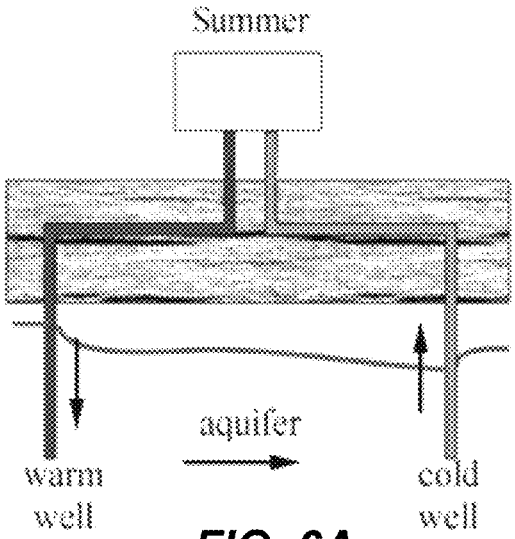
FIGS. 6A-6B show ground water flow in an ATES during winter and summer.
Figure 6B:
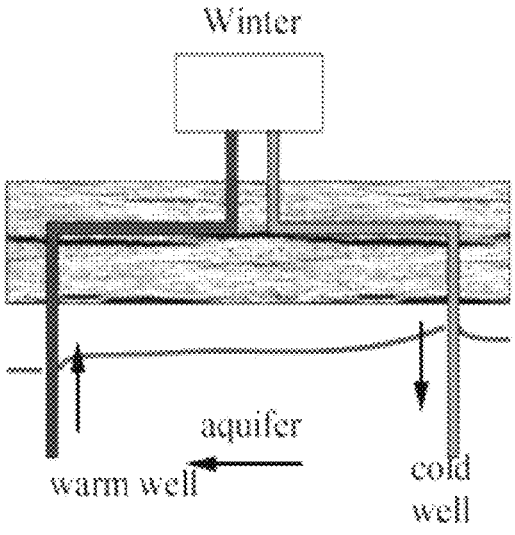
FIG. 6B (prior art)
Figure 7A:
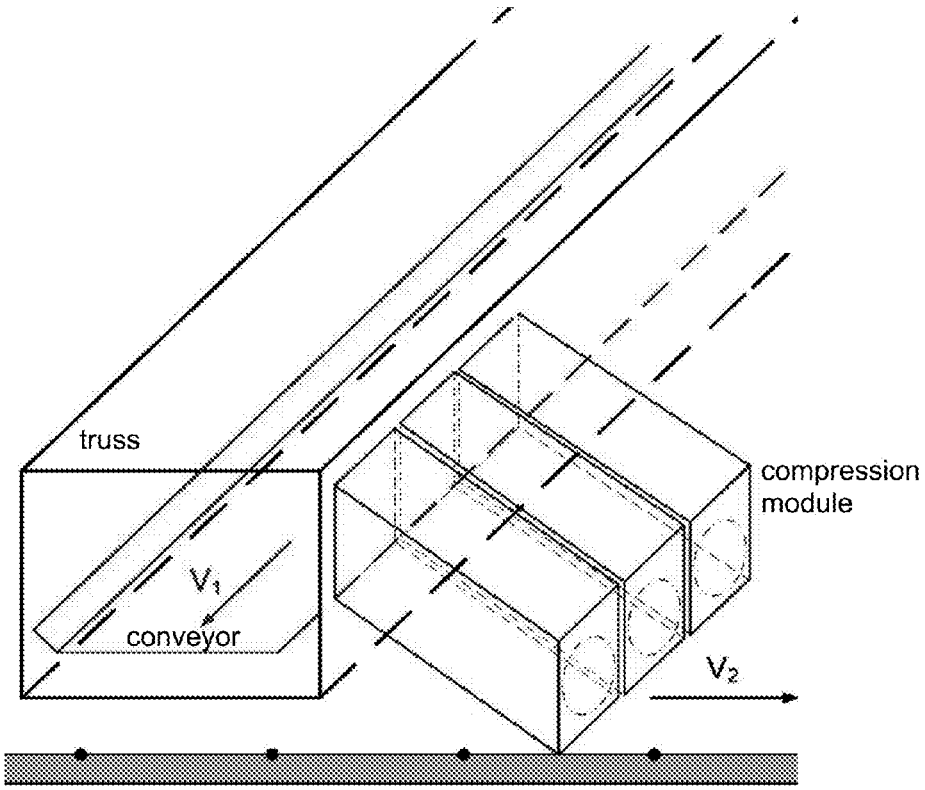
FIGS. 7A-7B show schematic views of the snow removal system with 7A showing compression modules to remove the snow directly from the runway surface and deposit it on a conveyor, which transports the snow away from the runway, where the conveyor is suspended in a truss on wheels, and 7B showing a sweeper and vacuum integrated with the snow removal system, according to embodiments of the current invention.
Figure 7B:
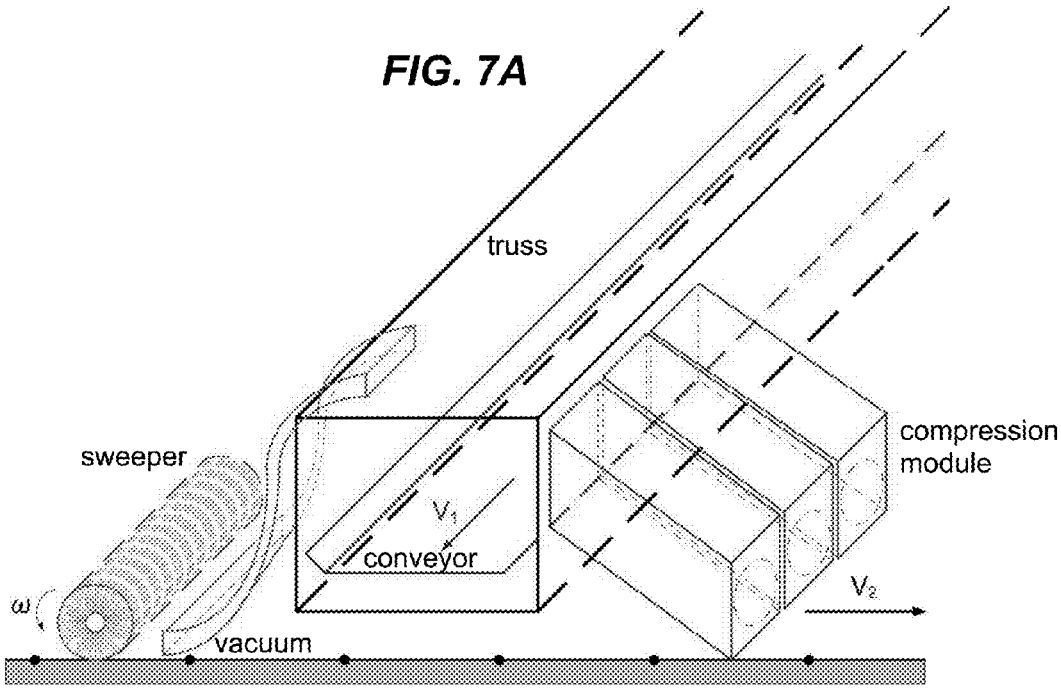

FIGS. 7A-7B show exemplary embodiments of the current invention, where compression modules form one plow on the front side, which is (preferably) perpendicular to the normal direction. In each compression module a conveyor screw is suspended. The conveyor screw compresses the snow to reduce the volume flow of snow by extracting the air from the snow. The majority of the snow is deposited through the conveyor screw onto the conveyor, this conveyor is suspended in a truss. This truss is driven by an engine. The conveyor deposits the compressed snow away from the runway surface, for example on the other side of the landing lights, as shown in FIG. 7A. In one embodiment, the conveyor is suspended in a truss on wheels. In one embodiment, the snow can be stored by the snow removal system without using the conveyor.

FIG. 7B shows another embodiment of the invention, where a bush brushes or loosens remaining layers of (compressed) snow from (the pores of) the tarmac. A vacuum vacuums the loosened snow onto the conveyor. The compression modules can be decoupled from the truss. The machine further has the possibility to spray potassium formate on the runway. In one example, the potassium formate sprayer is behind the brush. In a further embodiment, the nozzles that spray could also be suspended on the truss.

In one example, the snow removal system has a width of 20 meters and takes all the snow directly off the runway. An exemplary velocity of 10 m/s and a snow height of 10 cm the volume flow of fresh snow is 20 $m^3$/s. The velocity of standard rubber conveyors is limited to 7 m/s and have a maximum width of 2.2 m. The internal friction angle of snow is about 15° and is density dependant, as is described in equation (3) below. A pile of snow is therefore steep instead of sand for example. The resulting height of the snow in the snow removal system is therefore about 1.5 m. By compressing the snow, the height and width of the truss can be decreased and more snow can be processed and stored by the snow removal system according to the current invention.

In a further embodiment, the snow removal system has compression modules that are suspended to the truss by conventional mounting to enable suspending other modules, for example brushes, from the snow removal system.

Figure 8:
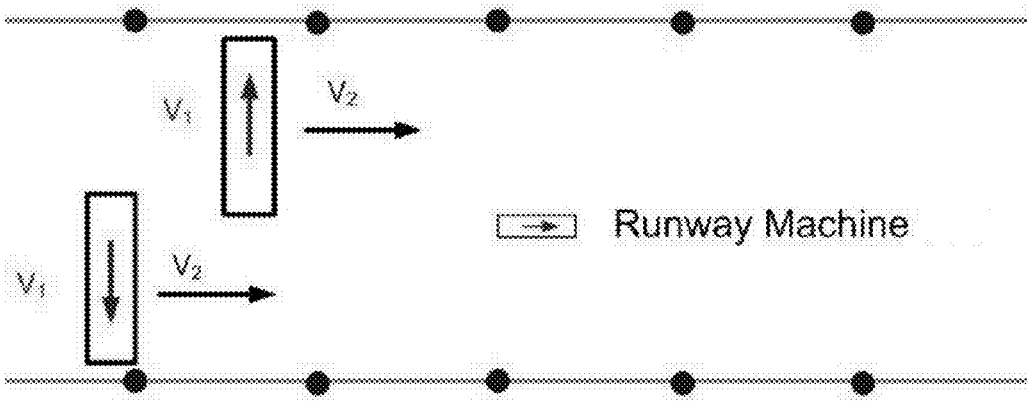
FIG. 8 shows a schematic view of two snow removal systems that drive over a runway, according to one embodiment of the current invention.

The present invention allows airports to reduce the costs of their winter operations by replacing a fleet of independently operated machines with 1 or 2 snow removal system machines of the current invention, each operated by one operator. FIG. 8 shows a machine driving forward with a velocity $V_2$ on a runway and depositing snow with velocity $V_1$ on the other side of the landing lights.

One or more machines according to the invention could be used for snow or dirt removal as well as sweeping of runways, roads, freeways, parking lots, storage grounds, sidewalks or the like. FIG. 8 shows an example of how two machines could be used removing the snow from a runway. In this example, each machine could be a little wider than half the width of a runway. If the machine according to this invention is used for sweeping a runway then the velocity $V_1$ equals zero, thereby collecting the dirt on the conveyor.

Figure 9A:
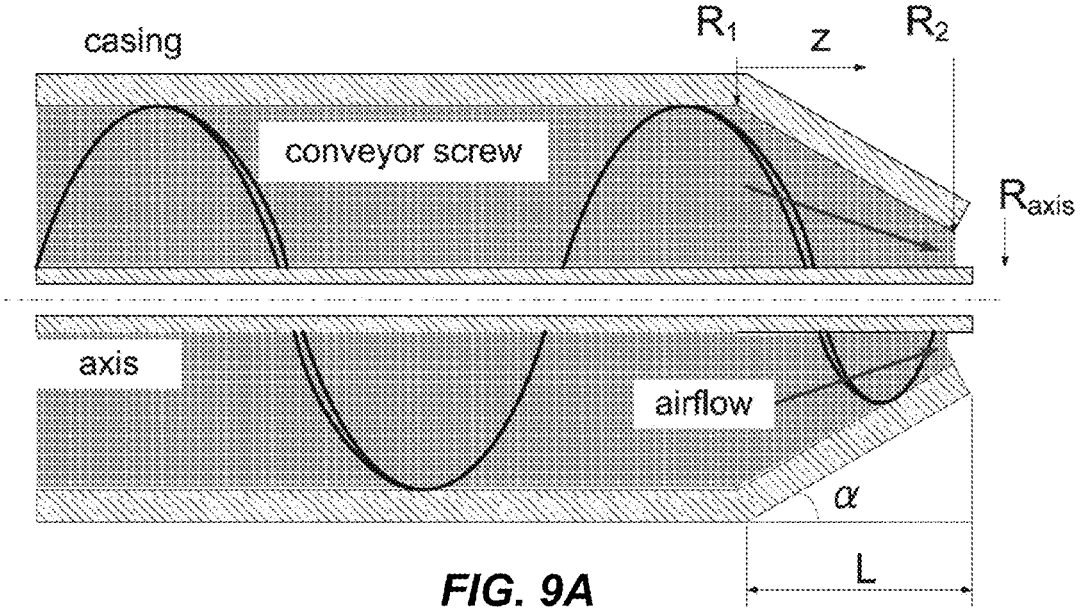
FIGS. 9A-9C show the dimensions of the compression module shown with axial airflow through snow due to an un-perforated casing, radial airflow through snow due to a perforated casing, and a graph of required torque with and without air holes, respectively, according to one embodiment of the invention.
Figure 9B:
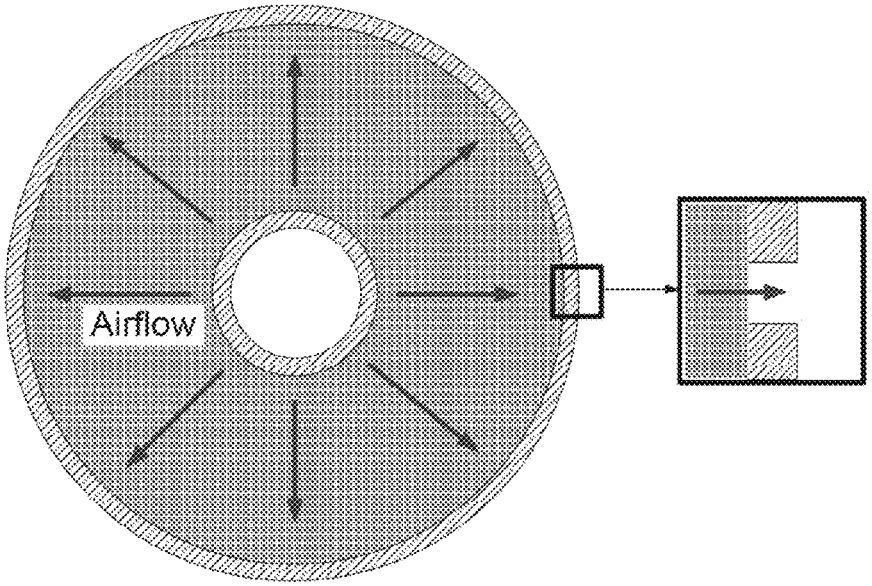

According to the current invention, the compression module reduces the volume flow of the removed snow. This leads to a significant decrease of the dimensions of the machine, which advances the technology in the art. In the compression module, a conveyor screw presses the snow through a casing. According to the current invention, there are three manners to compress the snow: a decreasing outer radius, an increasing inner radius and/or a decreasing pitch. An exemplary velocity of the machine is 10 m/s and an angular velocity of the screw of 750 RPM. In one embodiment, the dimensions of the compression module shown in FIGS. 9A-9B are: $R_1$=0.15 m, $R_2$=0.25 m, $R_{axis}$=0.10 m and L=1 m. The power needed to achieve compression, excluding drive train losses, can be split in four components: pressure drop of air, compression of snow, the friction at the wall and the pumping of snow over a height.

Figure 9C:
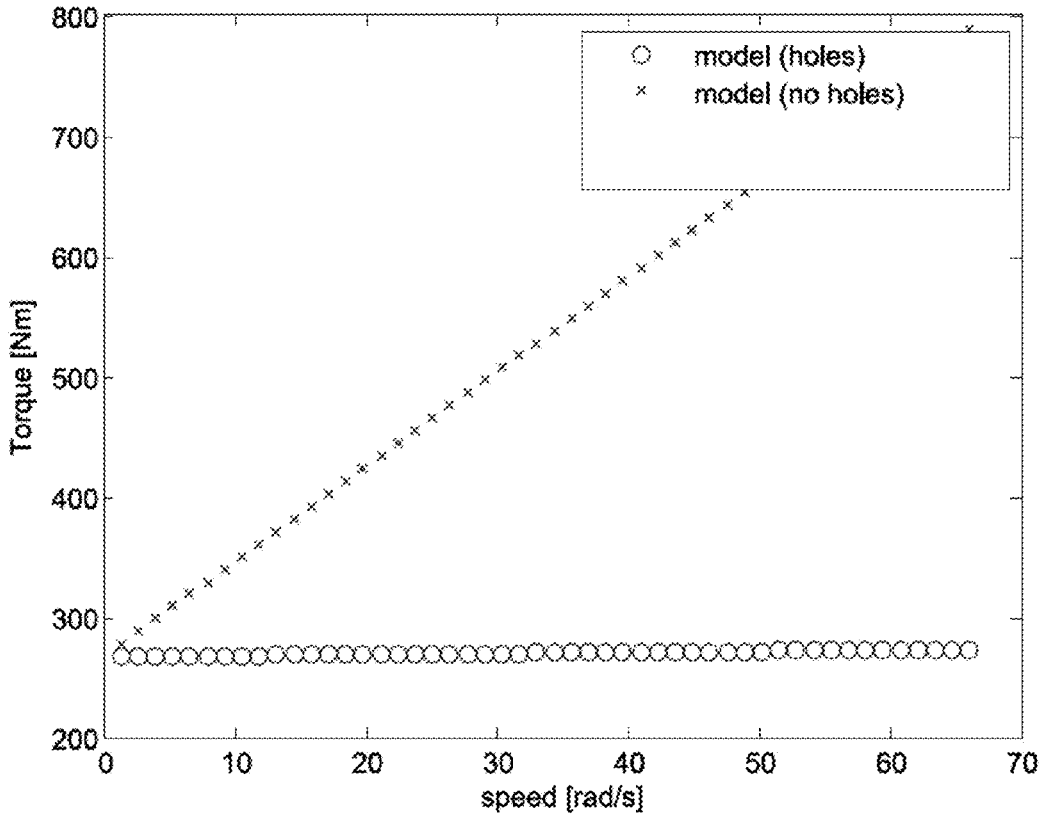

FIG. 9C shows a graph of the required torque for the compression module to compress snow and output the compressed snow for a tubular casing with and without holes, where the circle is the applied torque with holes and the cross the torque without holes.

According to the current invention, the reduction of volume flow of snow equals the volume flow of air through the snow, thus a pressure drops needs to be overcome. For example, at typical velocities and dimensions the power needed to overcome this pressure drop is in the order of 35 kW per compression module, as is shown in FIG. 9C. The width of an example machine is about 20 m, meaning 40 compression modules and 1400 kW is needed to overcome the pressure drop due to the airflow. According to one embodiment, the casing is perforated with air holes, as is shown in FIG. 9B, the air is released perpendicular to the normal direction of the snow. The power needed to overcome this pressure drop is about 0.40 kW per compression module and 16 kW for the entire machine. According to the current invention, by removing the air through holes of the casing and/or hollow screw axis the required power to overcome the pressure drop through snow compression is reduced from 35 to 0.40 kW per compression module on a total of 54 kW per compression module.

Here, the snow is compressed by removing air encapsulated by the water crystals of the snowflakes, where the snowflakes collapse to reduce the volume of the snow. During the snow compression, the snow crystals are deformed and the air encapsulated between the water crystals is released from the snowflakes and escapes through the holes of the casing of the compression unit or through the holes in a hollow conveyor screw shaft.

According to the current invention, another component of the required power is the power to compress the snow. Snow falls at a density of 50-100 kg/$m^3$. Due to the braking of inter-granular bonds the density can increase to 500 kg/$m^3$, this is called the critical density. Due to creep deformation the density can increase further. According to the current invention, the compression module compresses the snow towards the critical density. In one example, the compression module requires a power of about 54 kW and a total power of 2160 kW at typical velocities and dimensions.

According to the current invention, another component of the required power is due to friction at the wall. At high temperatures of 0° C. the friction is dominated by a film layer of water between snow and wall. A casing of a hydrophobic material can minimize this friction. At low temperatures of about −30° C. the friction is dominated by the plastic deformation of snow grains at the wall and is typically higher than at high temperatures. In one example, the compression module requires a power of about 15 kW and a total power of 600 kW at typical velocities and dimensions.

Snow is a complex three-phase material and is created in the air. Water is present in air in the form of water vapor. If air rises from warm lower layers to cold upper layers due to a density difference it will be cooled. This decrease of temperature leads to a decrease of water vapor air can contain. When the maximum concentration of water vapor in air is reached, the surplus of water vapor will condensate. Sublimation into a nuclei of ice occurs at temperatures below −10° C., but can still occur at about −3° C.

Once a nuclei of ice is formed the growth is dominated by attachment kinetics in combination with two transport processes, mass and heat diffusion. The origin of diversity in falling snow is due to three sources.

The first source is the variation in crystal size at nucleation. The second source is the variation in trajectories of each snowflake, i.e. each snowflake has a unique trajectory. The third source is due to temperature heterogeneities along each trajectory. These sources prescribe that each snowflake experiences unique circumstances during growth, resulting in unique snowflakes.

An international classification for seasonal snow on the ground to distinguish different kinds of snow has characteristics of the microstructure that include: grain shape and grain size and bulk properties of snow are density ($\sigma$), liquid water content ($\theta_w$) and the snow temperature ($T_s$). The mechanical properties of snow are strongly dependent on the ice and air spaces. This microstructure of snow is a complex matter, since each snowflake is unique as discussed in the previous subsection. The microstructure of snow changes over time, making the description of the mechanical properties of snow a daunting task.

The grain size can differ from very fine (<0.2 mm) to extreme (>5.0 mm). Since only precipitation particles are considered, the distinction in grain shape is irrelevant. The liquid water content is the mass or volumetric percentage of water in liquid phase within the snow.

The density is easily measured and is the most common quantity to identify snow. It is however a bulk property and it only provides a coarse prescription of the snow microstructure. The specific surface area (SSA) of snow is an important parameter for the characterization of porous media and is used more frequently in recent snow research. Here, the SSA and the intrinsic permeability provide a good framework in classifying snow.

The density of fresh snow varies from 50 to 100 kg/m$^3$. Under loading snow easily deforms, these high density changes are due to the collapse of pores resulting from braking of inter-granular bonds. The density tends to an asymptotic value of about 500 kg/m$^3$ in rapid confined compression. This density is called the critical density. Due to creep deformation the density of snow can increase further and above 830 kg/m$^3$ it is called ice.

Figure 14:
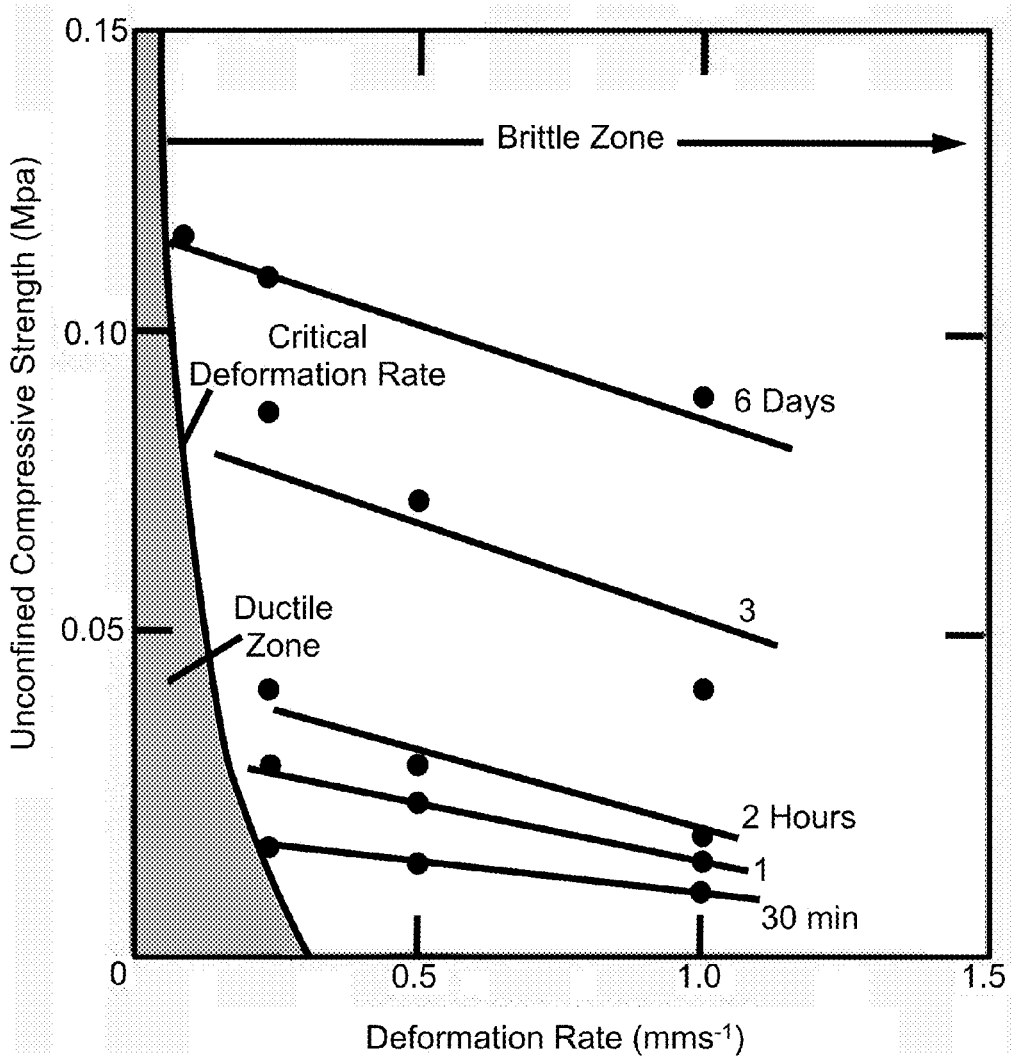
FIG. 14 shows the power needed to overcome pressure drop versus $\alpha$ for different compression ratios for the axial (solid lines) and radial (dotted lines) case.

The compressive strength is determined by the microstructure of snow, which is made out of a network of ice grains. Deformation can occur plastically through the slip of individual ice grains or brittle through the disjointment of ice grains. Here, the junction between these two deformation mechanisms is made by a critical compressive velocity on the order of 0.01 mm/s. This is shown in FIG. 14.

At values above this compressive velocity brittle deformation is dominant. In one embodiment, the snow removal machine operates at 1-10 m/s, implying brittle deformation dominates.

Figure 10:
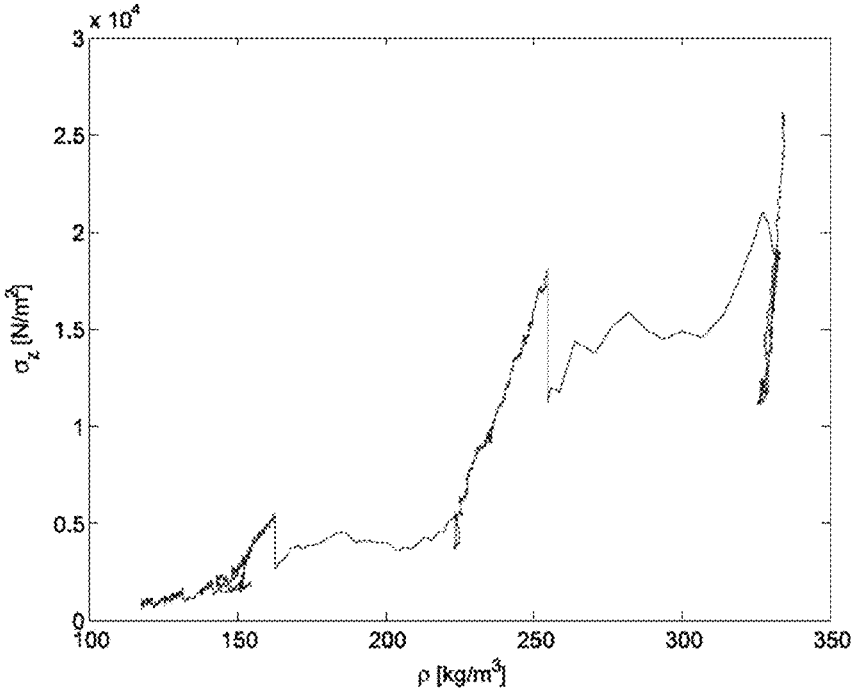
FIG. 10 shows a graph of the applied pressure in z-direction versus density at a deformation rate.
Figure 11:
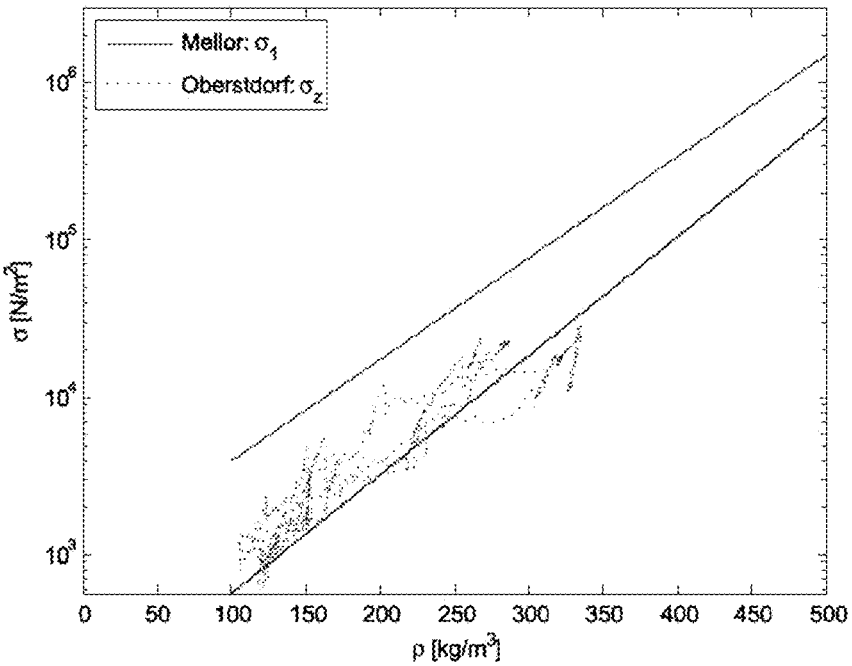
FIG. 11 shows a graph of applied pressure versus density.
Figure 12:
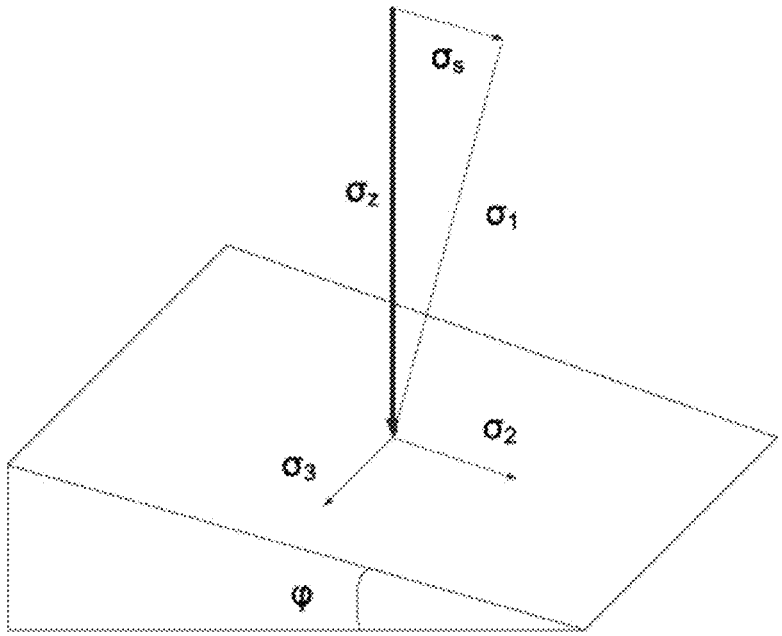
FIG. 12 shows applied stress $\sigma_z$ and resulting shear and principal stresses.

FIG. 10 clearly indicates brittle deformation as the dominant deformation process. It suggests the compressive strength cannot be specified by a function, but through a domain. Here, the upper boundary of this domain is given by equation (1) and the lower boundary by equation (2).

$$\sigma_u = p_u e^{a_u \rho'} \tag{1}$$

$$\sigma_l = p_l e^{a_l \rho'} \tag{2}$$

where $p_u$=900 Pa and $p_l$=100 Pa are the fictitious compressive strength of the respectively upper and lower boundary at zero density. The coefficients are $a_u$=14.84 m$^3$/Mg and $a_l$=17.403/Mg. The unit of $\rho'$ in these equations is Mg/m$^3$. The domain is based on eleven data sets for strain rates between $10^{-4}$ and $10^{-2}$ s$^{-1}$. The strain rates in this example are between 0.1 and 0.5 s$^{-1}$, indicating the domain is valid for higher strain rates. Results are shown in FIG. 11, where two stress conditions in z-direction are shown. The internal friction angle of snow is measured and is given in equation (3).

$$\phi = -0.016\rho + 17 \tag{3}$$

where $\phi$ is the angle in degrees. FIG. 12 indicates the stresses in first normal direction and z-direction are almost equal due to the small internal friction angle.

The obtained results of the friction angle and compressive strength provide the possibility to calculate the shear strength of snow. The shear strength $\sigma_s$ of FIG. 12 can be calculated by using equations (1), (2) and (3). The upper and lower boundary of this result is given by the straight lines in FIG. 13. This is in good agreement with the shear strength of equation (5) to indicate cohesion, which is explained below.

The relationship between the three principal stresses in the normal directions is shown in FIG. 12. This relationship is based on experiments.

$$\sigma_2 = K_0 \sigma_1 = \sigma_3 \tag{4}$$

where $K_0$ is approximately 0.12.

Figure 13:
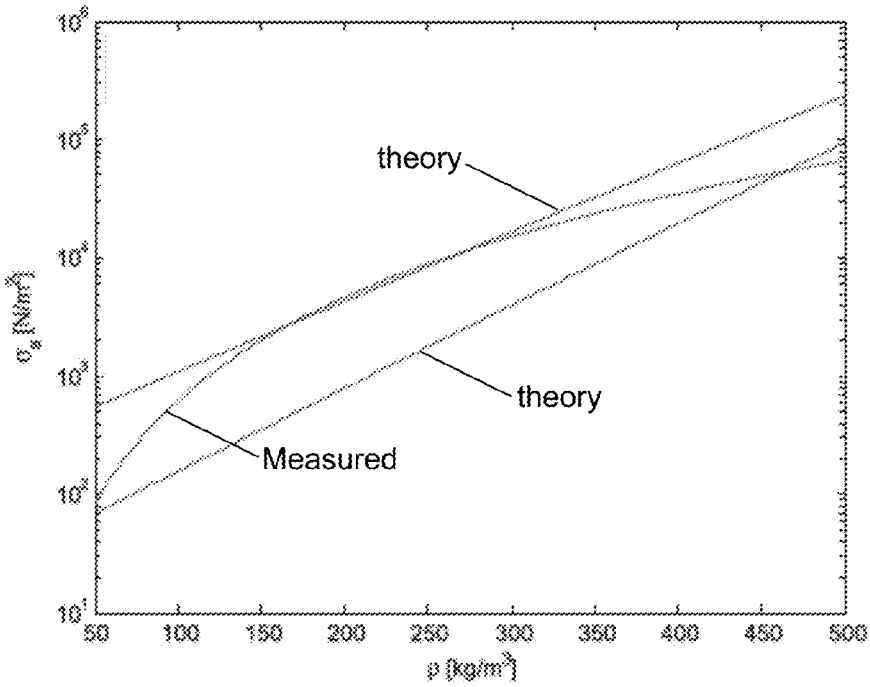
FIG. 13 shows unconfined compressive strength versus deformation rate.

The microstructure of snow changes in time, i.e. snow ages. Four distinct process that causes the aging of snow include sintering, interlocking, capillarity and freezing. During sintering the number of contact points between snowflakes increases. Interlocking occurs due to the interlocking of snowflakes. Capillarity plays a role when the liquid water content is greater than zero and freezing is relevant when the liquid water content of snow refreezes. The unconfined compressive strength of snow of different ages are measured. The unconfined compressive strength of the snow samples increased by a factor 10 as they sintered at constant density, as can be seen in FIG. 13. The age of snow is therefore important information.

It is difficult to make a snowpack of fresh dry snow, such as a snowball. This is due to a lack of sufficient inter-granular bonds between snow grains. When the number of bonds between grains increases due to aging it might be possible to make a snowball. For example when the temperature rises, the liquid water content of the snow increases. This leads to a stronger capillary bonding and a higher cohesion.

The shear strength is a good measure for the cohesion of a snowpack. Based on the previous findings the shear strength should be a function of a parameter, which describes the microstructure of the snow. In literature however the shear strength is a function of density. In avalanche forecasting the shear strength is a criteria for whether an avalanche will occur. Shear strength is suggested to be a function of the dry density and the liquid water content and is given in equation (5).

$$\sigma_s = K\rho_{dry}{}^{a}e^{b\theta_w} \tag{5}$$

where σ is the shear strength (N), K is an experimentally determined coefficient and is $9.40\times10^{-4}$ for new, decomposed and dry snow. ρ dry is the dry density, a is 2.91 $m^{7.73}/kg^{1.91}$ $s^2$ and b is −0.235 ($\%^{-1}$). The liquid water content in FIG. 13 equals zero.

Adhesion is the tendency of non-identical materials to stick to each other. The number of grain contacts of snow on the supporting surface influences the strength of the attachment. The temperature is an important parameter in the magnitude of adhesion. At temperatures between −6.7° C. and 0° C. the liquid water content is sufficient to increase the contact of snow to its support surface. The adhesion of snow to a support surface should be limited in the design of snow removal equipment. A hydrophobic material would be beneficial to limit adhesion.

The design of an example of one embodiment of the compression module is provided. The determination of the design is based on four parts: the pressure drop due to the air flow in snow, the deformation of snow, the determination of the friction of snow at the wall and the pumping of snow over a height In the conveyor screw the decrease of volume flow of snow equals the volume flow of air through the snow towards the outlet. This implies a pressure drop has to be overcome. The order of the pressure drop can be calculated, where the intrinsic permeability for different types of snow is determined assuming Darcy's law. The intrinsic permeability of compacted fresh snow equals $2.10^{-9}$ $m^2$. An estimation of the order of the pressure drop for the conveyor screw can be made by the following assumptions:

screw blades do not contribute to the pressure drop laminar flow

Figure 15:
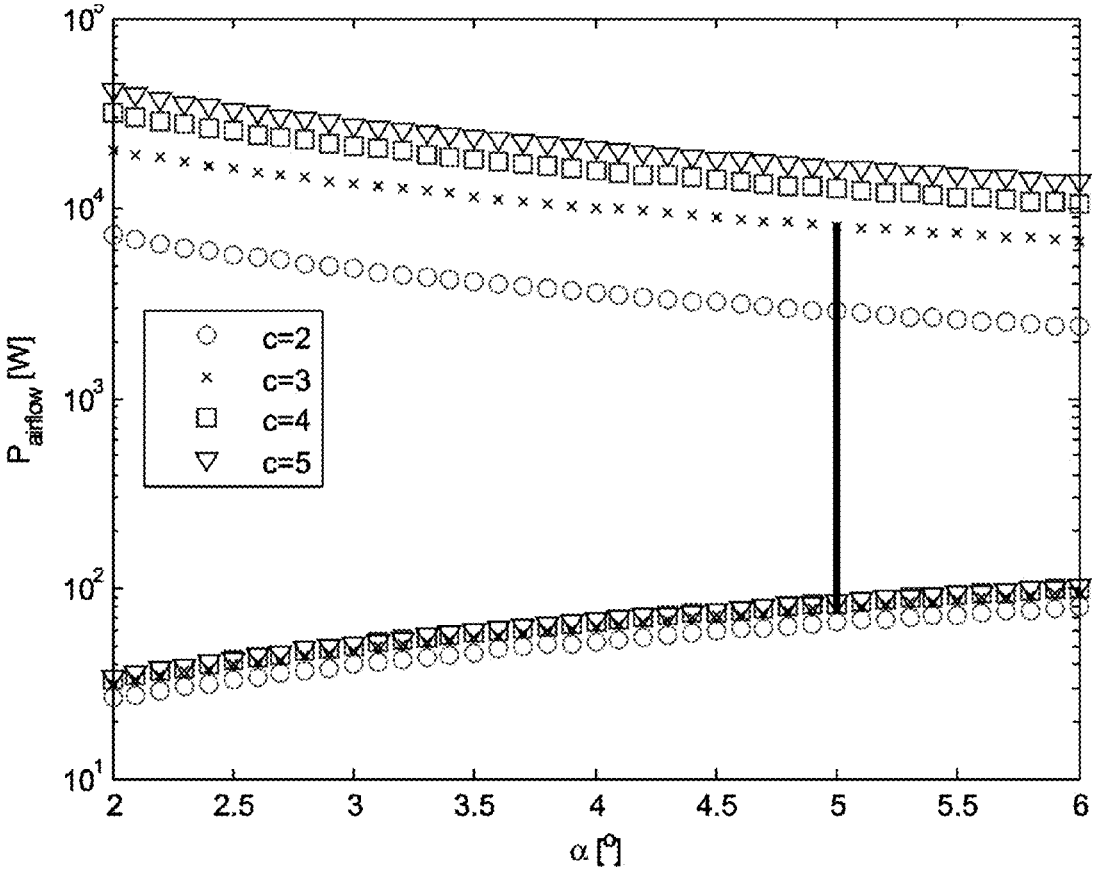
FIG. 15 shows a graph of the required power versus $\alpha$ and for different compression ratios in the radial and axial case.

Darcy's law is stated in equation (6).

$$\upsilon = -\frac{k_0}{\mu_{air}}\nabla p \tag{6}$$

where ν is the superficial velocity, $k_0$ the intrinsic permeability of snow, $\mu_{air}$ the dynamic viscosity of air and p is the pressure. There are two possibilities for the air to leave the compression module. The first possibility is that the air is removed axially at the outlet. The second possibility would be a radial airflow. In this case the casing of the compression module will be perforated. These two possibilities are shown respectively in FIGS. 9A-9B. The superficial velocity is defined as the volume rate of flow divided through a cross-sectional area of the solid plus gas. Darcy's equation for both cases is given in equations (7) and (8)

$$\Delta p_{axial} = \frac{Q_{air}\mu_{air}L}{A_{axial}k_0} \tag{7}$$

$$\Delta p_{radial} = \frac{Q_{air}\mu_{air}(R_2 - R_1)}{A_{radial}k_0} \tag{8}$$

where $\Delta_{paxial}$ is the pressure drop in the axial case, L the length of the compressing part of the screw conveyor, $\Delta_{pradial}$ is the pressure drop in the radial case, $R_1$ the radius at the start of compression and $R_2$ the radius at the outlet. $Q_{air}$ is the volumetric air flow and is given in equation (9)

$$Q_{air} = \nu_{snow}(A_1 - A_2) = \nu_{snow}A_2(c-1) \tag{9}$$

where $c=A_1/A_2$ is the compression ratio and $\nu_{snow}$ is the axial velocity of the snow in the compression module. The axial cross-sectional area is given in equation (10) and the lateral area is given in equation (11).

$$A_{axial} = \frac{1}{L}\int_o^L \pi(R^2 - R_{axis}^2)dz \tag{10}$$

$$A_{radial} = \frac{1}{2}(A_{outer} + A_{axis}) = \frac{1}{2}\left(\int_o^L 2\pi R dz + 2\pi R_{axis}L\right) \tag{11}$$

Where R is a function of z, the radius $R_1$=0.25 m and $R_{axis}$=0.10 m. A choice for α and c will fix $R_2$ and L. The required power versus α and for different compression ratios in the radial and axial case is given in FIG. 15. It is clear there is a significant difference between the required power between the axial and radial case.

Equation (6) is only valid for laminar flow. The Reynolds number for flows through porous media is:

$$Re = \frac{\rho_{air}\upsilon l_g}{\mu_{air}} \tag{12}$$

where $\rho_{air}$ is the density of air, ν the superficial velocity and $l_g$ the characteristic length of the pores. It was stated above the grain size of a snowflake ranges from 0.2 to 5.0 mm, in this case $l_g$ is chosen to be 0.1 mm, since it concerns snowflakes in a compressed state.

The domain Re<2 corresponds to laminar flow and Re>100 corresponds to turbulent flow. At a velocity of the snow sweeper of 10 m/s, $R_1$=0.25 m, α=5° and c=3 the Reynolds number of the radial case equals 2.4 and of the axial case 23. Therefore the Reynolds number for radial flow is laminar, while the Reynolds number for axial flow is in the transition regime. This implies the calculated pressure drop in the axial case must be corrected with an extra diffusion term, making the pressure drop even higher. It must be stated the required power for the radial case is in the situation when the casing does not resist the flow, i.e. when there is no casing. In reality the required power will be slightly higher than the dotted lines of FIG. 15. It can be concluded the perforation of the casing is a beneficial design aspect of the compression module.

As discussed above the deformation of snow in the snow sweeper will occur through brittle deformation. Below is the discussion to determine the power needed to compress the snow towards the critical density. FIG. 14 shows the age of snow influence the compressive strength by a factor ten. At small values of α the wall compresses the snow and at large values of α the screw compresses the snow. The boundary for small values of α is taken as the corner where the pressure in z-direction is 10% of the pressure in r-direction. This corner equals arctan(0.1)=5.7°.

Figure 16:
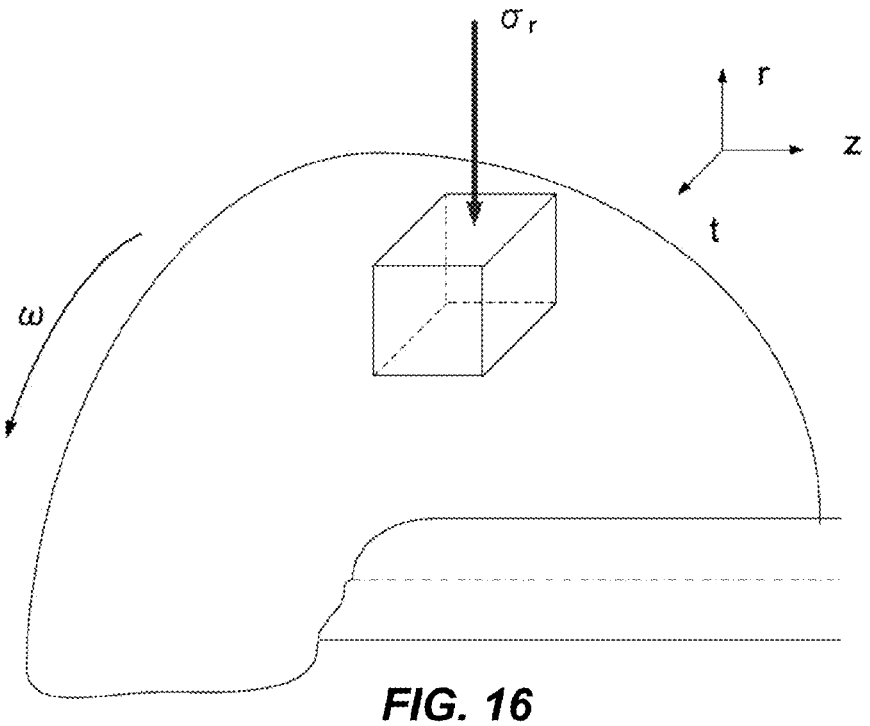
FIG. 16 shows the stresses due to compression on an infinitely small cube of snow.

The compressive stress in r-direction is shown in FIG. 16. The principal stresses are build up in the same manner as in FIG. 12. The compressive stress in r-direction results in two other stresses in z-direction and t-direction, indicated in FIG. 16. The pressure delivered by the screw in z-direction and t-direction both need to be bigger than the principal stresses decomposed in z-direction and t-direction. The principal stresses in 2 and 3 direction of FIG. 12 are given by equation (4). Since ϕ is small, cos(ϕ)≈1. This means $\sigma_3 \approx \sigma_t$ and $\sigma_2 \approx \sigma_z$.

Figure 17:
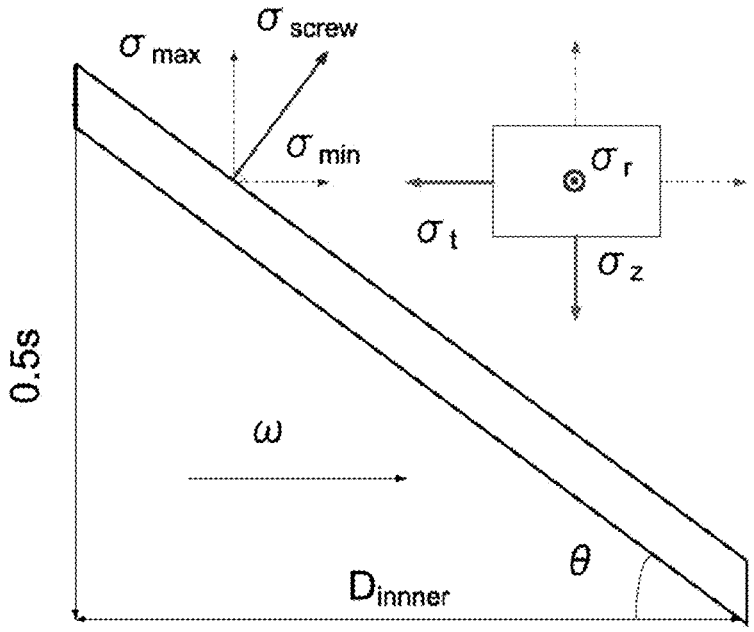
FIG. 17 shows the stresses on the screw due to compression, $\sigma_r$ is directed into the paper.
Figure 18:
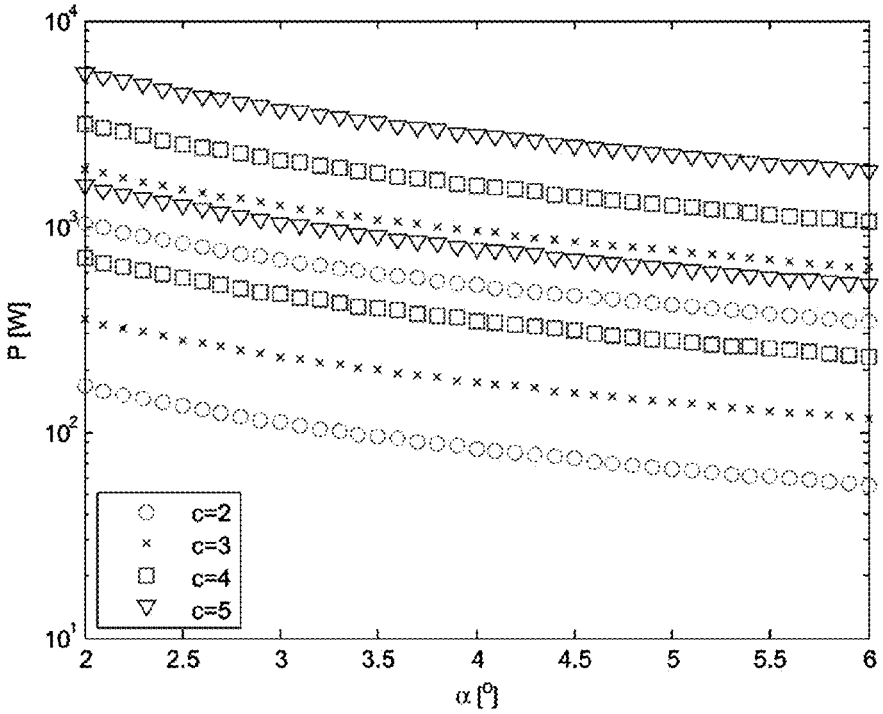
FIG. 18 shows a graph of the tower needed to compress the snow versus $\alpha$ for different compression ratios for the upper domain (solid lines) and the lower domain (dotted lines).

The minimal component $\sigma_{min}$ of the pressure by the screw on the snow determines the size of the pressure of the screw $\sigma_{screw}$, indicated in FIG. 17. Conventional conveyor screws have a pitch s, which is equal to the inner diameter ($D_{inner}$). This means the angle θ in FIG. 17 equals arctan(0.5)=27° and the minimal component of $\sigma_{screw}$ is in t-direction: $\sigma_{min}$=sin (270)$\sigma_{screw}$. The required power to compress the snow under the previous assumptions and method is given in FIG. 18 for the same initial conditions above ($R_1$=0.25 m, $R_{axis}$=0.10 m and $\sigma_0$=100 kg/m$^3$).

Dry friction occurs when two surfaces experience a relative lateral motion with respect to each other. The dry friction can be divided in two regimes. Static friction refers to surfaces not in motion and dynamic friction refers to surfaces in motion. In the compression module the snow experience a relative motion with respect to the casing, leading to dynamic friction. The size of the friction is related to the material properties of the two surfaces and the pressure normal to the wall.

$$p_f=\mu_d p_\perp \tag{13}$$

where $p_f$ equals the friction pressure at the wall, $\mu_d$ the dynamic friction coefficient and $p_\perp$ the normal pressure acting on the wall. For the compressing part of the conveyor screw $p_\perp$ is given in equation (14)

$$p_\perp=\cos(\alpha)p_i \tag{14}$$

where α is defined in equation (15) and $p_i$ is the pressure at position i for 0≤i≤L $$\alpha = a\tan\left(\frac{R_1 - R_2}{L}\right) \tag{15}$$

where $R_1$, $R_2$ and L are defined in FIG. 9A.

In order to minimize friction a material of the casing must be chosen with a minimal friction coefficient with respect to snow. The friction coefficient is also an indication of the adhesion. It therefore depends on parameters like the temperature, grain shape, grain size and the liquid water content. A hydrophobic material, like Teflon, would be the material of choice.

Figure 19:
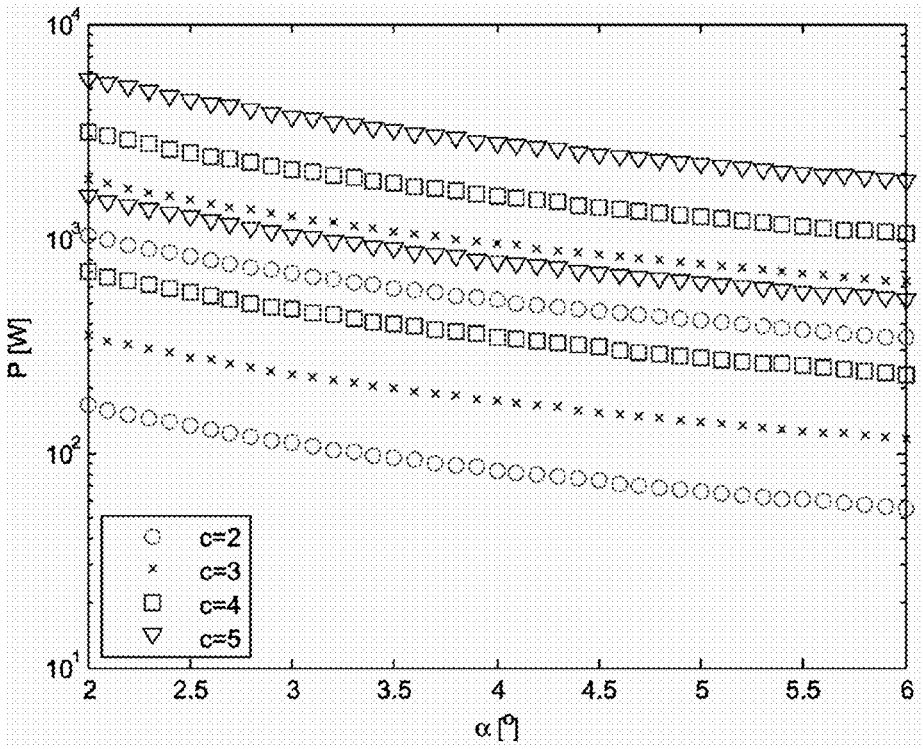
FIG. 19 shows a graph of the dynamic friction coefficient versus temperature.

FIG. 19 shows the temperature dependency of adhesion. At temperatures above 0° C. a full water lubrication layer is present on the inner surface of the casing and at 0° C. the layer is incomplete. The friction in the range of 0° C. is dominated by the viscous behavior of the film layer. Since the casing is made of Teflon the bonding between the water film layer and the casing is low. At lower temperatures the liquid water content diminishes and the friction is dominated by plastic deformation of snow crystals. The snow sweeper must be capable to operate in the Netherlands and in the Nordic countries where temperatures of −35° C. are normal.

Figure 20:
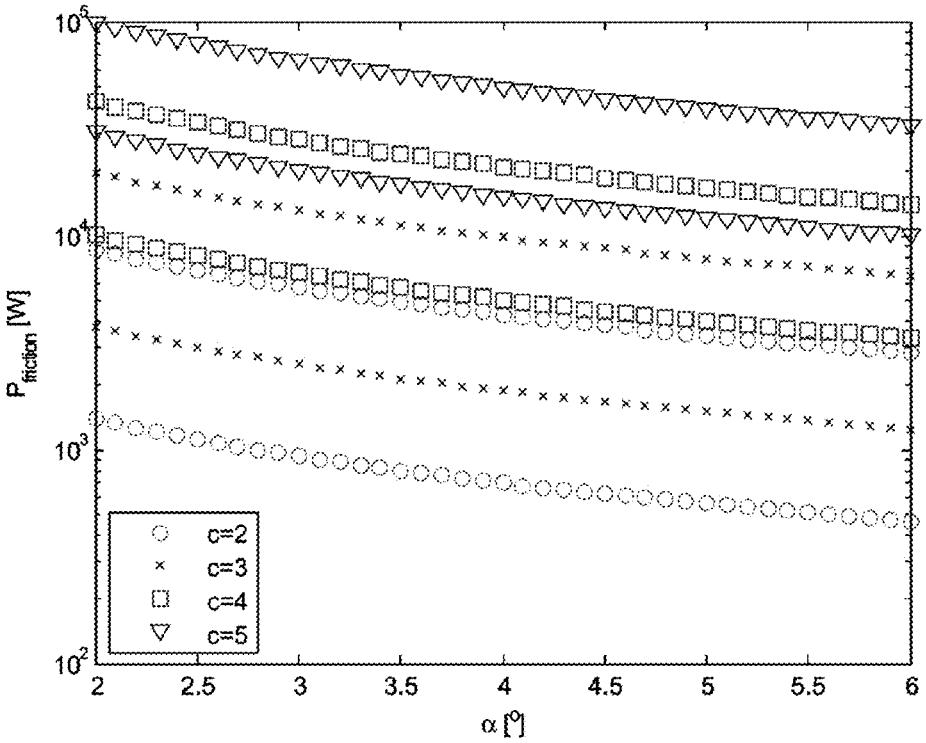
FIG. 20 shows a graph of the power needed to overcome the dynamic friction at the wall for $\mu_d$=0.05 at initial conditions.

The power needed to overcome friction for the same initial conditions as in the two previous sections is given in FIG. 20. The power needed to overcome friction is transferred into heat. This generated heat flows into the casing, the air and snow. At entrance no film layer is present at −35° C. With a 100 nm layer of snow to be present on Teflon at 0° C. sufficient heat is supplied to create a full film layer at −35° C. Therefore the dynamic friction coefficient $\mu_d$=0.05.

Figure 21:
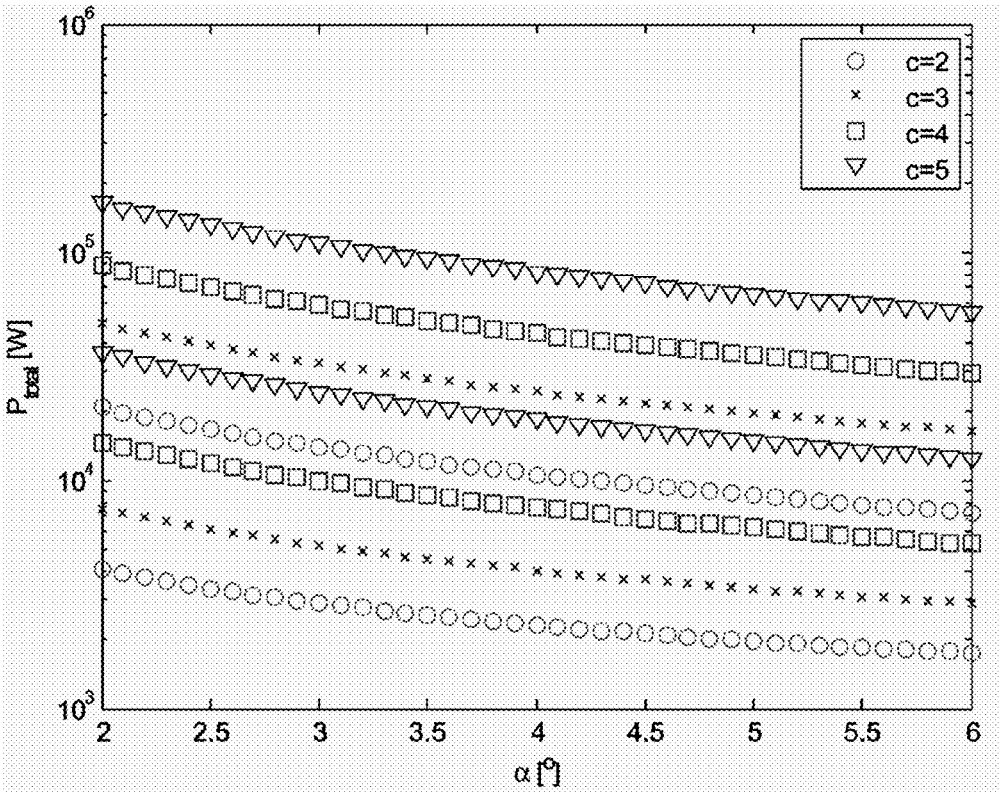
FIG. 21 shows a graph of the total power needed to compress the snow for $R_1$=0.25 m, $\rho_0$=100 kg/m$^3$ and $v_{machine}$=10 m/s.

The results of the discussion can be added to obtain the total power to compress the snow, excluding drive train losses, as shown in FIG. 21. The compression module decreases the volume flow, which leads to realistic values of the snow sweeper. The choice for a compression ratio is a trade off between power to compress the snow and dimensions of the snow sweeper. The breadth of a snow sweeper is about 20 m, which means 40 compression modules are required for one snow sweeper. A power of 10 kW per compression modules means a total power of 400 kW to compress the snow for one snow sweeper at a speed of 10 m/s. The geometry is chosen to be the following:

$$\alpha=5° \text{ and } c=3$$

At this geometry the required power is 3.3≤P≤19.5 kW per compression module and a total power of 132≤P≤780 kW.

An exemplary snow removal system is provided. The test lower limit condition is a few centimeters slush and the upper limit is a lot of dry snow. The example was conducted in Raasdorf in the east of Vienna, Austria. Both the upper and lower limit snow conditions were experienced in Raasdorf.

In the example, the compressions module was suspended with a category 2 front top hitch on a Massey Ferguson 7475 tractor from 2005. The forward velocity, hydraulic oil flow rate and the height of the compression module were operated.

Provided is a working example of the compressive module. The boundary conditions for the model verification are:

The mass flow at the inlet equals the mass flow at the outlet. The mass flow of the air leaving the compression module through the air holes is neglected, since the density of snow is a hundredfold of the air density. It is shown that snow is incapable of penetrating the air holes.

$$\dot{m}_{inlet}=\dot{m}_{outlet} \tag{16}$$

The fill factor is 100%, i.e. the start of the compression pipe is completely filled with snow. This boundary condition implies a relationship between the angular velocity of the screw and the forward velocity of the tractor. The relationship is based on the conservation of mass between the snow taken by the prototype and the casing inlet. The resulting relation between the tractor velocity and the angular screw velocity is given in equation (17).

$$v_{tractor} = \frac{sc_1}{2bh}(R_0^2 - R_{axis}^2)\omega \tag{17}$$

Where $v_{tractor}$ is the tractor forward velocity, s=0.5 m and is the pitch of the screw, $c_1$≈1.5 and is the compression factor due to plowing, b=0.5 m and is the width of the compression module, h is the snow height, $R_0$=0.25 m and is the initial inner radius of the conus, $R_{axis}$=0.045 m and is the radius of the axis of the screw and ω is the angular velocity of the screw.

The processed snow was untouched, i.e. uncompressed. This snow is denoted as fresh snow.

When the boundary conditions are fulfilled the model will be tested for two different situations. Afterwards the holes were covered. The fraction of the required power for the pressure drop through air flow is minimal according the model. A significant power increase is expected in the second situation.

The size of the tarmac site in this example was 200 by 40 meters. The width of the tractor is 2.67 meters, providing the number of passes per snowfall of about ten. Each pass represents a traveled distance by the tractor of 200 meters.

Figure 22:
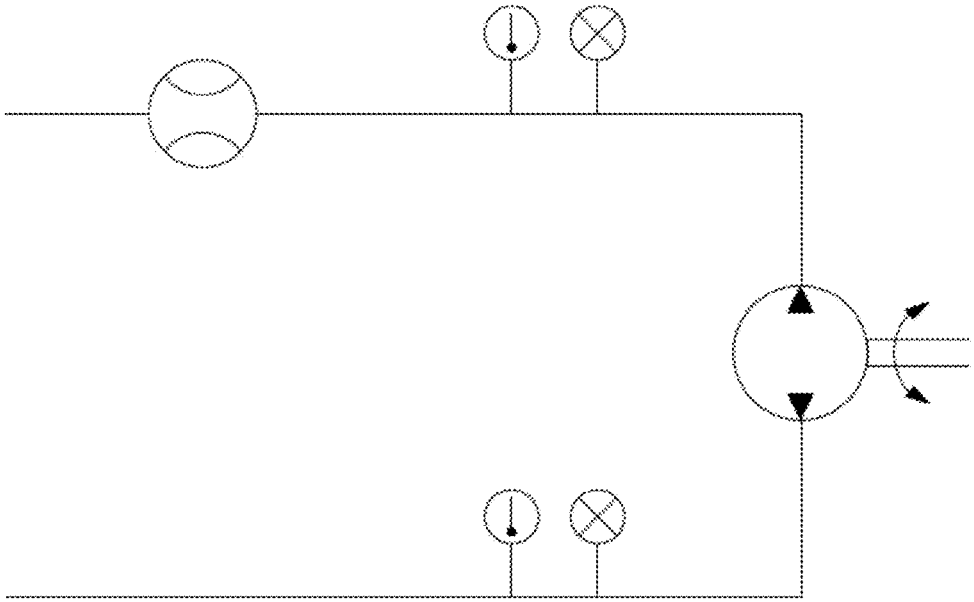
FIG. 22 shows a hydraulic diagram of the compression module drive and sensors, according to one embodiment of the invention.

The Parker Torqmotor TE130 was driven by the load sensing system of the Massey Ferguson 7475 tractor. The hydraulic diagram of the motor and sensors is given in FIG. 22.

First the oil from the tractor flows through the flow meter and then through the motor back to the tractor. At the inlet and outlet of the motor Parker SCPT sensors are located. These sensors can measure both pressure and temperature of the oil. The measured pressure drop is only over the motor of the screw, since the sensors are located at inlet and outlet of the motor.

Figure 23:
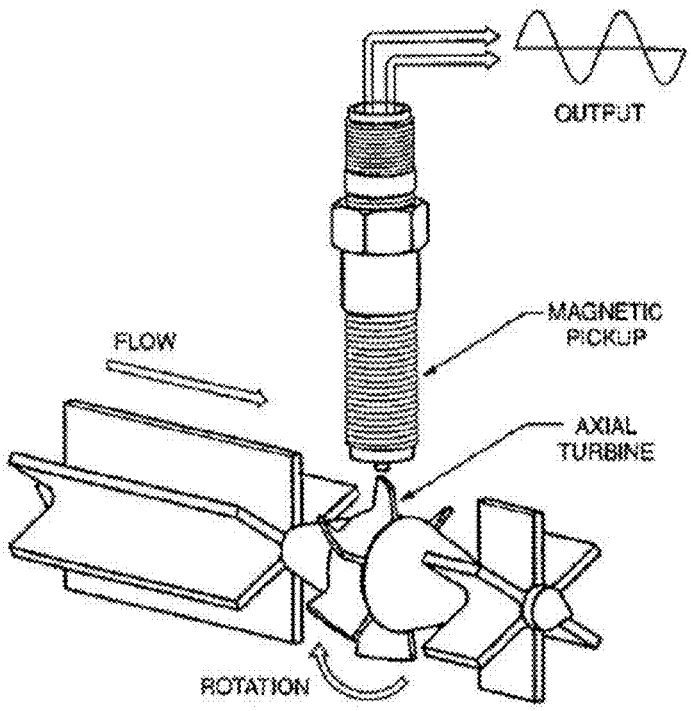
FIG. 23 shows Measurement principle of the Parker flow turbine meter SCFT-150-02-02.

The hydraulic flow turbine meter is a Parker SCFT-150-02-02 with a maximum pressure of 420 bar and a maximum flow of 150 L/min. The measurement principle of the flow meter is illustrated in FIG. 23. A part of the fluid energy is converted in rotational energy of the rotor. A pulse meter counts the rotor blades, which results in a signal containing the number of revolutions per time unit of the rotor. This signal is correlated to the volume flow.

The hydraulic temperature and pressure meter is a Parker SCPT-400-02-02 with a maximum pressure of 400 bar and a temperature range from −25° C. to 105° C.

The measurement of a pass of a compression module over 2 centimeters slush was executed at Jan. 8, 2013. Some accumulated snow at the front of the pass fell back, which explains the remainders on the snow-free pass of the compression module. The tractor velocity was 25 km/h. And the flow was set at 20 L/min during this experiment.

The measurement of a pass of the compression module over 7 centimeters of wet snow was executed at Jan. 14, 2013. The ground temperature was sufficient in order for direct snow accumulation on the ground to occur. The ambient temperature was −1° C. Through these conditions the resulting snow can be denoted as wet snow. The fluid layer around each snow crystal allows a strong bonding between them in comparison to dry snow where a fluid layer does not exist.

In this example, the density of the snow on the asphalt was calculated by dividing the measured mass through the measured volume. The mass was determined with a scale at an accuracy of 0.5 gram. The surface area was identical to the inner surface area of a pipe and the height was measured with a rod. A sample of compressed snow has a density of about 300 kg/m$^3$.

The measurement of a pass of the compression module over 30 centimeters dry snow was executed at Jan. 17, 2013. The ground temperature was sufficient in order for direct snow accumulation at the ground to occur. The ambient temperature was −2° C. and increased during the day to −0.5° C. It was difficult to make a snowball, where only through the application of a relative large force the snow was cohesive enough to maintain its spherical shape. The compression module was passed across the asphalt with a velocity of 25 km/h. As shown, the snow stream from the outlet is unaltered by the outlet design, since no snow eddies are present.

The snow fell back on the cleared asphalt. The flow rate was set at 32 L/min, which is the prescribed flow rate at h=30 cm and $v_{tractor}$=25 km/h.

Figure 24:
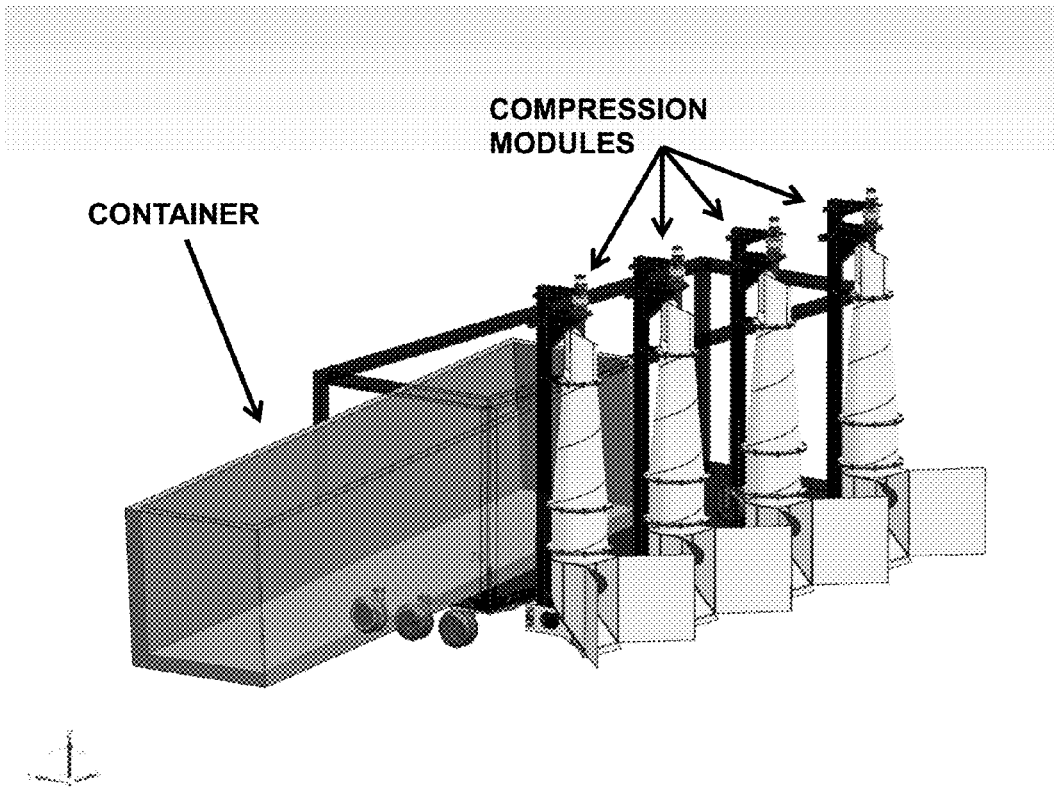
FIG. 24 shows a compression module and container system, according to one embodiment of the invention.

FIG. 24 shows a schematic drawing of a snow removal system, according to one embodiment of the invention, where the invention includes a snow removal system, a compression module having a tubular casing with a snow inlet and a snow outlet, where the snow outlet includes a converging or decreasing cross-sectional surface area tubular shape, where the tubular casing is perforated with air holes, a road contacting device, for example a snow plow, a conveyor screw with a constant or decreasing pitch that rotates on an axis that is disposed concentric to the tubular casing, where the conveyor screw spans from the snow inlet to the snow outlet, where the conveyor screw is powered to move snow from the snow inlet to the snow outlet and compacts the snow to a compressed state by the converging tubular shape, where the compressed snow is output from the snow outlet, and a snow container that receives the compressed snow output from the snow outlet, where the snow container can be configured to store or exert the compressed snow. In one aspect, the snow container is a dumping container. In another aspect the container is a snow cube exerting container.

Figure 25A:
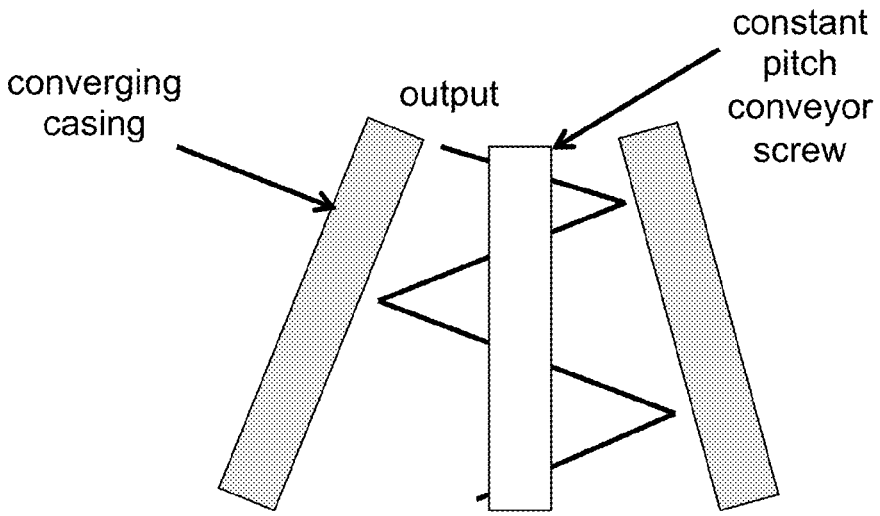
FIGS. 25A-25C show different embodiments of the compression module having a converging casing and constant pitch screw, straight casing and diverging screw, and straight casing and decreasing screw pitch, respectively, where it is understood that any of the screw profiles may be hollow with air holes and any of the casing profiles may have air holes, according to different embodiments of the invention.
Figure 25B:
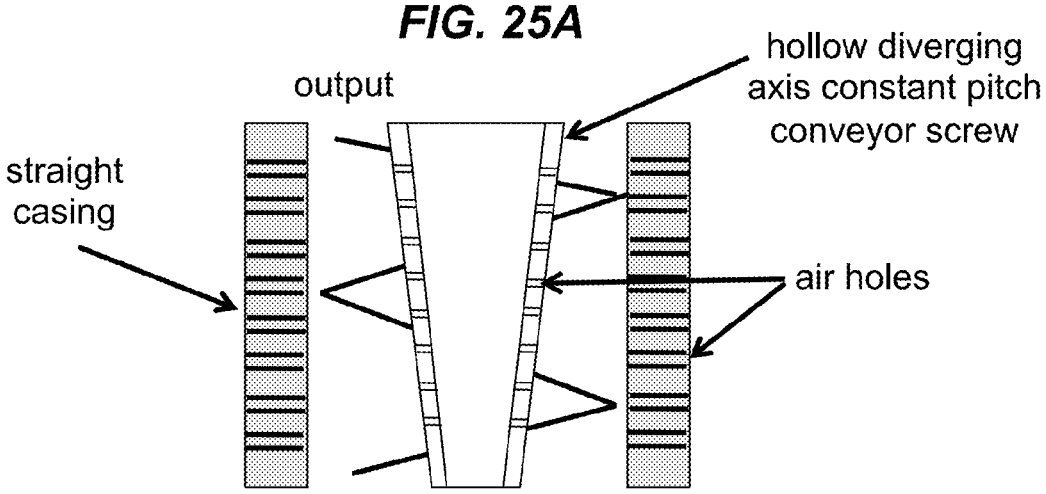
Figure 25C:
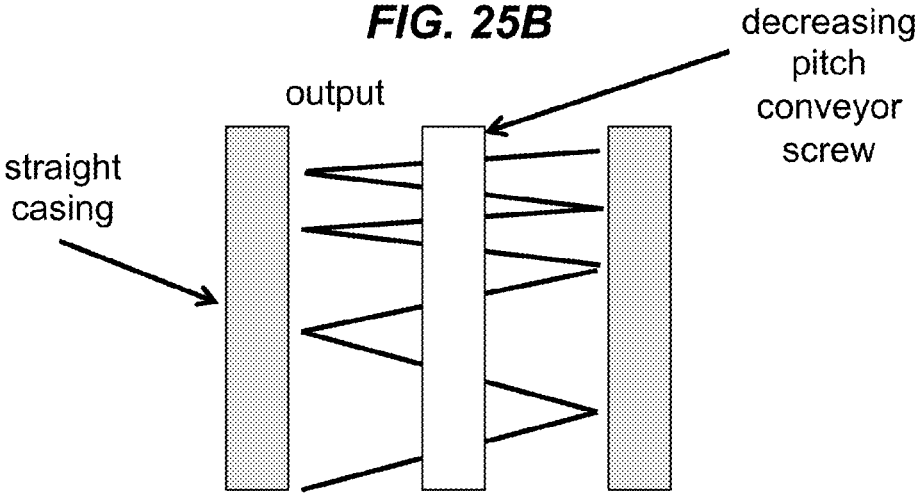

FIGS. 25A-25C show different embodiments of the compression module having a converging casing and constant pitch screw, straight casing and diverging shaft of the screw, and straight casing and decreasing screw pitch, respectively, where it is understood that any of the screw profiles may be hollow with air holes and any of the casing profiles may have air holes, according to different embodiments of the invention.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. All such variations are considered to be within the scope and spirit of the present invention as defined by the following claims and their legal equivalents.

What is claimed:

1. A snow removal system, comprising:

a. a compression module, wherein said compression module comprises:

i. a tubular casing, wherein said tubular casing comprises a snow inlet and a snow outlet, wherein said snow outlet comprises a converging or straight cross-section tubular shape, wherein said tubular casing is perforated with air holes, where said snow inlet comprises a road contacting device;

ii. a conveyor screw, wherein said conveyor screw rotates on a shaft that is disposed concentric to said tubular casing, wherein said conveyor screw spans from said snow inlet to said snow outlet, wherein said conveyor screw is powered to move snow from said snow inlet to said snow outlet and compacts said snow to a compressed state at the snow outlet, wherein air from said snow is exhausted through said air holes, wherein said compressed snow is output from said snow outlet;

b. a conveyor belt, wherein said conveyor belt is disposed to receive said compressed snow from said snow outlet, wherein said conveyor belt is disposed to move said compressed snow at a velocity $v_1$ from said snow outlet to a location away from said compression module; and c. a moveable truss, wherein said moveable truss houses said conveyor belt, wherein said movable truss supports said compression module, wherein said movable truss moves at a velocity $v_2$ in a direction perpendicular to said road contacting device, wherein said $v_1$ is a value that is great enough to remove said compressed snow away from said compression module when said truss moves at a velocity $v_2$, wherein said conveyor screw motor turns said conveyor screw to output said compressed snow at a rate that incorporates said $v_1$ and said $v_2$ to ensure a capacity to move said compressed snow away from compression module by said conveyor belt is not exceeded.

2. The snow removal system of claim 1, wherein said truss further comprise a sweeper and a vacuum, wherein said sweeper and said vacuum are disposed behind said movable truss and inline with said compression module, wherein said sweeper sweeps snow from said snow-covered surface to said vacuum, wherein said vacuum outputs said swept snow to said conveyor belt.

3. The snow removal system of claim 1, wherein said truss further comprise an anti freeze liquid sprayer, wherein said anti freeze liquid sprayer deposits anti freeze to a surface removed of snow.

4. The snow removal system of claim 1, wherein said conveyor screw shaft comprise a hollow shaft that is perforated with air holes, wherein air from said snow is exhausted through said air holes.

5. The snow removal system of claim 1, wherein said conveyor screw shaft comprises a diverging shaft cross-section along said snow outlet.

6. The snow removal system of claim 1, wherein said conveyor screw comprise a constant screw pitch or a decreasing screw pitch.

7. The snow removal system of claim 1, wherein said movable truss comprises a driving truss or a towable truss.

8. A snow removal system, comprising a compression module, wherein said compression module comprises:

a. a tubular casing, wherein said tubular casing comprises a snow inlet and a snow outlet, wherein said snow outlet comprises a converging or straight cross-section tubular shape, wherein said tubular casing is circumferentially perforated with air holes; and b. a conveyor screw, wherein said conveyor screw rotates on an axis that is disposed concentric to said tubular casing, wherein said conveyor screw spans from said snow inlet to said snow outlet, wherein said conveyor screw is powered to move snow from said snow inlet to said snow outlet and compacts said snow to a compressed state at said snow outlet, wherein air from said snow is exhausted through said, circumferential air hole perforations, wherein said conveyor screw is disposed to compresses said snow to a reduced volume state by extracting the air from said snow, wherein said circumferential air hole perforations are disposed to alleviate pressure on said powered conveyor screw from said compressed snow, wherein said compressed snow is output from said snow outlet.

9. The snow removal system of claim 8 further comprises a snow container, wherein said snow container receives said compressed snow output from said snow outlet, wherein said snow container transports said compressed snow.

10. The snow removal system of claim 9, wherein said snow container comprises a dumping container, or a snow cube exerting container.

11. The snow removal system of claim 8, wherein said conveyor screw shaft comprises a hollow shaft that is perforated with air holes, wherein air from said snow is exhausted through said air holes.

12. The snow removal system of claim 8, wherein said conveyor screw shaft comprises a diverging shaft cross-section along said snow outlet.

13. The snow removal system of claim 8, wherein said conveyor screw comprise a constant screw pitch or a decreasing screw pitch.

* * * * *